US009368050B2

(12) United States Patent
Bigham et al.

(10) Patent No.: US 9,368,050 B2
(45) Date of Patent: Jun. 14, 2016

(54) DETACHABLE VEHICLE-MOUNTED BANNER ASSEMBLY HAVING IMPROVED DISPLAY AND MOUNTING FEATURES

(71) Applicant: HardFlags, LLC, Montgomery, AL (US)

(72) Inventors: Shannon Harold Bigham, Montgomery, AL (US); Jason Sloane Bigham, Auburn, AL (US); Lance Nicholas Covert, Montgomery, AL (US); James Hansford Ward, Jr., Deatsville, AL (US)

(73) Assignee: HardFlags, LLC, Montgomery, AL (US)

( * ) Notice: Subject to any disclaimer, the term of this patent is extended or adjusted under 35 U.S.C. 154(b) by 115 days.

(21) Appl. No.: 14/304,450

(22) Filed: Jun. 13, 2014

(65) Prior Publication Data

US 2015/0033604 A1 Feb. 5, 2015

Related U.S. Application Data

(60) Provisional application No. 61/860,376, filed on Jul. 31, 2013.

(51) Int. Cl.
*G09F 17/00* (2006.01)

(52) U.S. Cl.
CPC ..... *G09F 17/00* (2013.01); *G09F 2017/0075* (2013.01)

(58) Field of Classification Search
CPC ..... G09F 21/04; G09F 7/04; A63H 33/40; G01P 13/02
USPC ..... 40/591, 602, 607.01, 643; 248/222.11, 248/520, 521; 116/52; 403/343; 73/170.05
See application file for complete search history.

(56) References Cited

U.S. PATENT DOCUMENTS

| | | | | | |
|---|---|---|---|---|---|
| 1,448,825 | A | * | 3/1923 | Bolander | 116/173 |
| 1,857,774 | A | * | 5/1932 | Wickman | 248/537 |
| D152,378 | S | | 1/1949 | Skinner | |
| 2,527,357 | A | | 10/1950 | Donahey | |
| 2,546,855 | A | | 3/1951 | Frame | |
| 2,601,088 | A | * | 6/1952 | Burgess | 248/539 |
| 2,764,122 | A | | 9/1956 | Irvin | |
| 2,949,606 | A | * | 8/1960 | Dorne | 343/708 |
| 2,999,149 | A | | 9/1961 | Cook, Jr. | |
| 3,060,605 | A | * | 10/1962 | Flack | 40/591 |
| 3,081,054 | A | * | 3/1963 | Westervelt | 248/537 |
| 3,136,289 | A | | 6/1964 | Johnson | |

(Continued)

*Primary Examiner* — Charles A Fox
*Assistant Examiner* — Christopher E Veraa
(74) *Attorney, Agent, or Firm* — Alston & Bird LLP

(57) ABSTRACT

A detachable vehicle-mounted banner assembly is provided, comprising a banner panel defining two opposing and at least semi-rigid surfaces, the surfaces comprising at least a leading edge; a banner mast comprising a base portion and a flanged portion, the flanged portion comprising an angled leading edge and a trailing slot, the trailing slot being configured to selectively engage at least the leading edge; and a base assembly having a first portion configured for attachment to a vehicle and a second portion configured to attachment relative to the base portion. The base portion is elongate and has a base longitudinal axis about which the banner mast and the banner panel pivot; and the flanged portion of the banner mast extends away from the base portion and has a flange longitudinal axis oriented at an acute angle relative to the base longitudinal axis. A method of mounting the assembly is also provided.

24 Claims, 15 Drawing Sheets

(56) References Cited

U.S. PATENT DOCUMENTS

| | | | | | |
|---|---|---|---|---|---|
| 3,148,856 | A | * | 9/1964 | Orlando | 248/205.6 |
| 3,172,220 | A | * | 3/1965 | Christensen | 40/479 |
| 3,178,139 | A | | 4/1965 | Mcfarlin | |
| 3,239,957 | A | | 3/1966 | Snediker | |
| 3,241,516 | A | * | 3/1966 | Hopkins | 116/173 |
| 3,245,165 | A | * | 4/1966 | Podoloff | 40/591 |
| 3,280,790 | A | | 10/1966 | Booth | |
| 3,526,050 | A | * | 9/1970 | Weller | 40/591 |
| 3,672,323 | A | | 6/1972 | Hawes | |
| 3,686,938 | A | | 8/1972 | Binckley | |
| 3,715,821 | A | | 2/1973 | Hawes | |
| 3,762,360 | A | | 10/1973 | Hawes | |
| 3,882,721 | A | | 5/1975 | Neary et al. | |
| 4,114,160 | A | * | 9/1978 | Verini | 343/715 |
| 4,121,088 | A | | 10/1978 | Doremus et al. | |
| 4,163,426 | A | | 8/1979 | O'Neill | |
| 4,194,852 | A | * | 3/1980 | Cupp et al. | 403/299 |
| 4,519,153 | A | | 5/1985 | Moon et al. | |
| 4,574,726 | A | | 3/1986 | Sullivan | |
| 4,582,017 | A | * | 4/1986 | Ostermiller | 116/28 R |
| 4,583,310 | A | * | 4/1986 | Seiler | 40/592 |
| 4,590,883 | A | | 5/1986 | Steed et al. | |
| 4,633,215 | A | | 12/1986 | Anders et al. | |
| 4,650,147 | A | | 3/1987 | Griffin | |
| 4,686,785 | A | * | 8/1987 | Obbermito | 40/607.13 |
| 4,700,655 | A | | 10/1987 | Kirby | |
| D293,659 | S | | 1/1988 | Griffin | |
| 4,804,154 | A | * | 2/1989 | Davis | 244/1 R |
| D313,214 | S | | 12/1990 | Phillips et al. | |
| 4,986,209 | A | | 1/1991 | Spica | |
| 5,042,418 | A | | 8/1991 | Hoover et al. | |
| 5,048,451 | A | * | 9/1991 | Reimers et al. | 116/35 A |
| 5,182,146 | A | * | 1/1993 | O'Hara | 428/31 |
| 5,233,938 | A | | 8/1993 | Lalo | |
| 5,320,061 | A | | 6/1994 | Laughlin et al. | |
| 5,323,728 | A | * | 6/1994 | Hjelm | 116/63 T |
| 5,339,551 | A | * | 8/1994 | Elmer | 40/591 |
| 5,363,792 | A | * | 11/1994 | Petechik | 116/28 R |
| 5,388,546 | A | | 2/1995 | Lombard | |
| D360,229 | S | | 7/1995 | Caulk | |
| D360,843 | S | | 8/1995 | Harris | |
| D362,411 | S | | 9/1995 | Doyle | |
| 5,463,974 | A | * | 11/1995 | Seeder | 116/173 |
| 5,483,916 | A | | 1/1996 | Kolvites et al. | |
| 5,524,857 | A | | 6/1996 | Eisenberg et al. | |
| 5,572,945 | A | * | 11/1996 | Eastaugh | 116/173 |
| 5,727,497 | A | | 3/1998 | Nichols, Jr. | |
| 5,740,622 | A | * | 4/1998 | Martin | G09F 17/00 116/173 |
| 5,921,199 | A | * | 7/1999 | Gross | 116/28 R |
| 5,992,069 | A | | 11/1999 | McKew | |
| D420,308 | S | | 2/2000 | Turok | |
| 6,085,687 | A | | 7/2000 | Chester | |
| D432,945 | S | | 10/2000 | Icenhour | |
| 6,213,440 | B1 | | 4/2001 | Kornback | |
| 6,298,803 | B1 | | 10/2001 | Gregg | |
| 6,378,453 | B1 | | 4/2002 | Conway | |
| D464,912 | S | | 10/2002 | Powell | |
| 6,695,269 | B1 | * | 2/2004 | Anscher | 248/225.11 |
| 6,913,233 | B2 | * | 7/2005 | Puett, III et al. | 248/229.1 |
| 7,047,680 | B2 | | 5/2006 | Myles | |
| 7,066,105 | B2 | | 6/2006 | Tal | |
| 7,147,399 | B2 | * | 12/2006 | Viscount et al. | 403/349 |
| 7,156,044 | B1 | * | 1/2007 | Davis | 116/28 R |
| 7,316,087 | B1 | * | 1/2008 | Smith | 40/591 |
| D564,595 | S | | 3/2008 | Barrett | |
| 7,455,311 | B2 | * | 11/2008 | Moore | 280/477 |
| D586,861 | S | | 2/2009 | Noble | |
| 7,594,478 | B2 | * | 9/2009 | Karnes et al. | 116/28 R |
| 7,637,226 | B1 | * | 12/2009 | Bradley | 116/28 R |
| 7,878,139 | B1 | | 2/2011 | Karnes et al. | |
| D638,745 | S | | 5/2011 | Nelson et al. | |
| 7,942,601 | B2 | * | 5/2011 | Bohman et al. | 403/343 |
| D657,712 | S | | 4/2012 | Bigbee | |
| 8,296,979 | B2 | | 10/2012 | Pereira et al. | |
| 8,430,052 | B2 | | 4/2013 | Nihra et al. | |
| 8,459,516 | B2 | * | 6/2013 | O'Regan et al. | 224/403 |
| 2003/0019998 | A1 | | 1/2003 | Kou | |
| 2003/0084835 | A1 | | 5/2003 | Chao | |
| 2004/0069923 | A1 | | 4/2004 | Steenbock | |
| 2004/0155170 | A1 | | 8/2004 | Thompson | |
| 2005/0178033 | A1 | * | 8/2005 | Elmer et al. | 40/600 |
| 2005/0217557 | A1 | | 10/2005 | Caetano et al. | |
| 2006/0086307 | A1 | * | 4/2006 | Kaz | 116/28 R |
| 2009/0013571 | A1 | | 1/2009 | Edmonds | |
| 2009/0158631 | A1 | * | 6/2009 | Christiansen et al. | 40/607.04 |
| 2010/0212199 | A1 | | 8/2010 | Edmonds | |
| 2012/0210930 | A1 | | 8/2012 | Lupoff | |
| 2013/0019795 | A1 | | 1/2013 | Leptien et al. | |
| 2013/0160336 | A1 | * | 6/2013 | Harman, Jr. | 40/559 |

* cited by examiner

DETACHABLE VEHICLE-MOUNTED BANNER ASSEMBLY HAVING IMPROVED DISPLAY AND MOUNTING FEATURES

CROSS-REFERENCE TO RELATED APPLICATIONS

This application claims priority to and the benefit of U.S. Provisional Patent Application Ser. No. 61/860,376, filed Jul. 31, 2013, the contents of which are hereby incorporated by reference in their entirety.

BACKGROUND

Many persons desire to display flags temporarily in a variety of locations fbr decorative purposes, as symbols of allegiance, support or affiliation, or as means for commercial advertising. As a non-limiting example, athletic team enthusiasts, such as college or high school students, their parents and relatives, as well as other team supporters, often wish to display a symbol, name, mascot, or color of their school as an expression of allegiance and support.

A prime opportunity fir displaying a team's symbols occurs when supporters are traveling in a vehicle (e.g., a truck, car, or the like) to and from athletic events in which their favorite team is playing. Other situations also occur in which a person may wish or be required to display a banner. As a non-limiting example, pleasure boaters may wish to display a banner from their boat for decorative or identification purposes. As another non-limiting example, mobile delivery companies may wish to display a banner advertising their services on one or more vehicles used by one or more employees.

Conventional display flags are prone to damage and/or loss. Many attach via vehicle windows and any inadvertent lowering of the window, particular during transit, can result in loss or damage to such display flags. Many conventional display flags are also made of cloth and thus susceptible to environmental condition and wear, particularly where travel occurs at high rates of speed. Thus, a need exists for a banner or flag display device that is configured for rapid and simple installation and removal from a vehicle and that also provides an improved degree of rigidity and durability so as to enhance the longevity of the device. A need also exists for such a banner or flag display device to be configured for simple and rapid interchangeability for those users who may want to display two or more different flags or banners within a short period of time. A need also exists for a banner or flag display device that is configured to maximize readability thereof regardless of the speed of movement of a vehicle upon which the device is mounted.

BRIEF SUMMARY

As mentioned, many conventional automobile-mounted banners comprise a cloth flag mounted to a fixed mast which flaps in the wind. The performance of the cloth flag is highly dependent on the automobile's speed (e.g., too slow and the flag is not extended and not readable; too fast and the flag flaps too frequently to read). The durability of such cloth flags is also very low. Various embodiments of the invention described herein provide a configuration that not only improves durability but also maintains readability at any travelling speed. Certain embodiments replace conventional cloth flags with a substantially rigid body configured to maintain steady alignment with an imposed airflow. Certain embodiments having the substantially rigid body concurrently improve readability, as the "hard" flag is always extended regardless of travelling speed.

According to various embodiments, a detachable vehicle-mounted banner assembly having improved display and mounting features is provided. The banner assembly comprises: a banner panel defining two opposing and at least semi-rigid surfaces, the surfaces comprising at least a leading edge; a banner mast comprising a base portion and a flanged portion, the flanged portion comprising an angled leading edge and a trailing slot, the trailing slot being configured to selectively engage at least the leading edge of the banner panel; and a base assembly having a first portion configured for attachment adjacent a surface of a vehicle and a second portion configured to attachment relative to the base portion of the banner mast. The base portion of the banner mast is elongate and has a base longitudinal axis about which the banner mast and the banner panel pivot; and the flanged portion of the banner mast extends away from the base portion, is elongate, and has a flange longitudinal axis oriented at an acute angle relative to the base longitudinal axis.

According to various embodiments, a method of mounting a detachable vehicle-mounted banner assembly having improved display and mounting features is provided. The method comprises the steps of: fixedly attaching a base assembly to a surface of the vehicle, the base assembly having a first portion configured for attachment adjacent the surface of the vehicle and a second portion configured to attachment relative to a base portion of a banner mast of the banner assembly; and selectively attaching the banner mast to the second portion of the base assembly, the banner mast comprising a base portion and a flanged portion, the flanged portion comprising an angled leading edge and a trailing slot, the trailing slot being configured to selectively engage at least a leading edge of a banner panel.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 5:
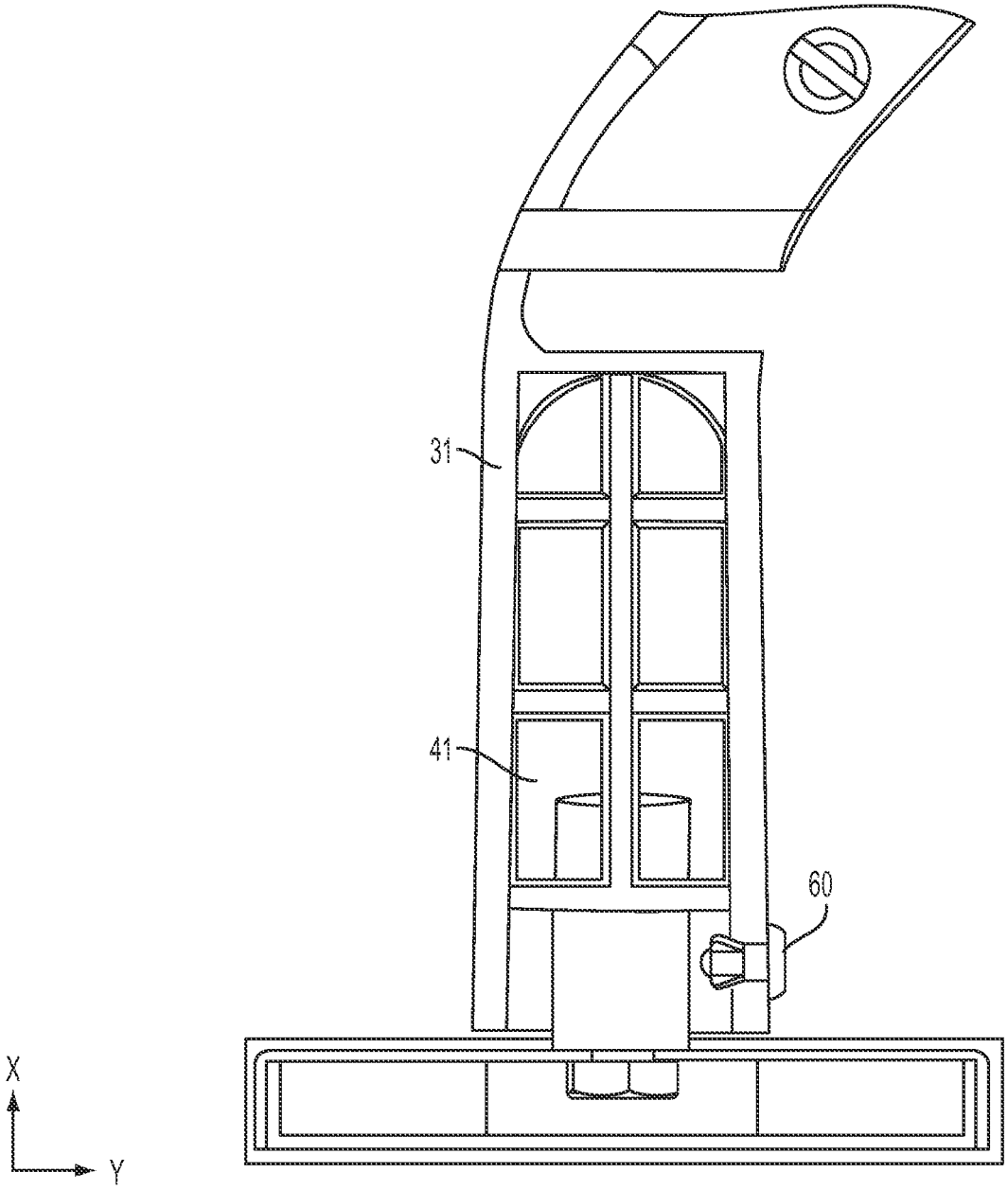

FIG. 5 is a partial, side elevational view of a portion of the banner assembly 10 according to the first exemplary embodiment of the present invention, namely a portion including the magnetic base assembly 40, with the banner mast base 31 in cross section.

Figure 6:
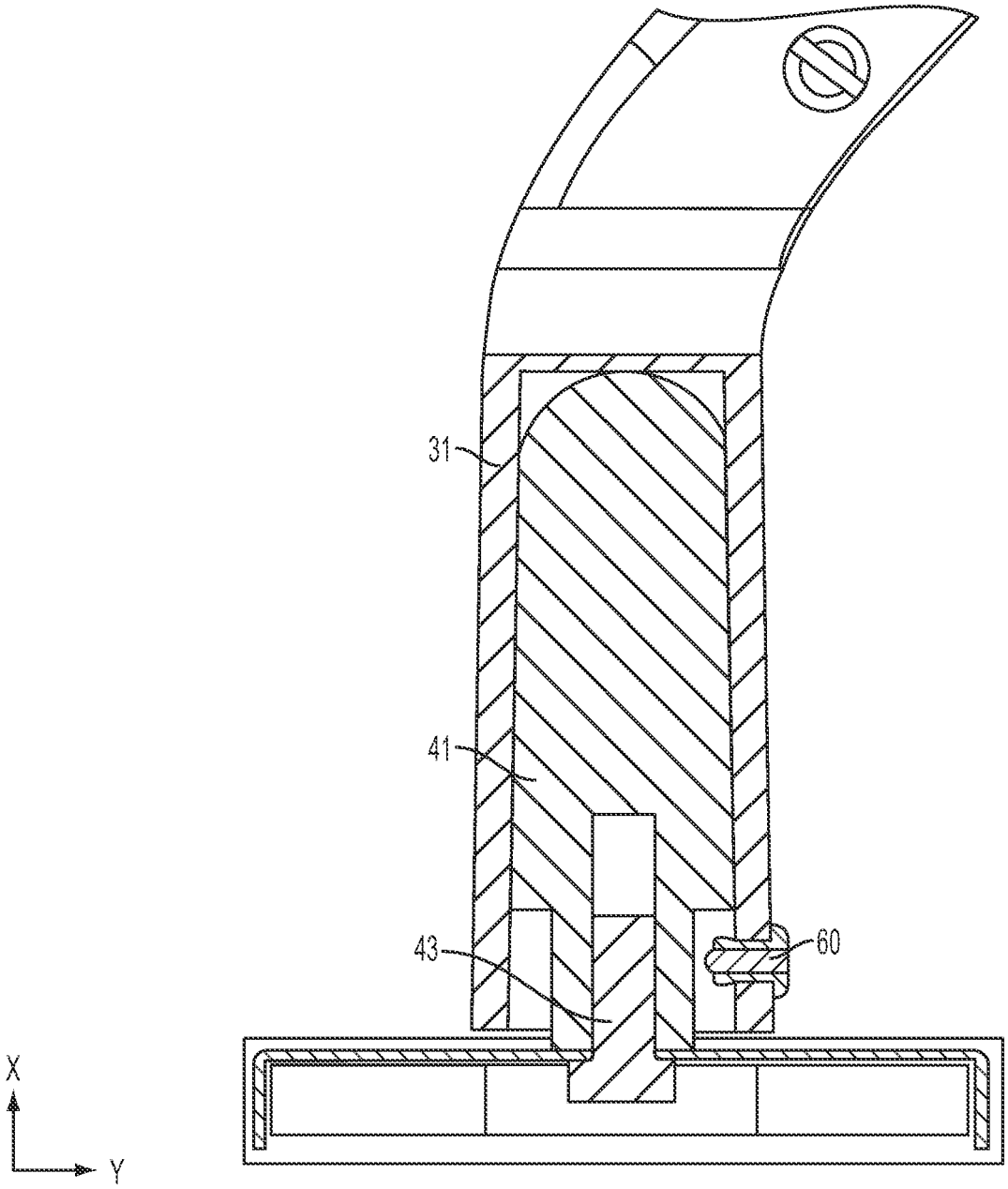

FIG. 6 is another partial, side elevational view of a portion of the banner assembly 10 according to the first exemplary embodiment of the present invention, namely a portion including the magnetic base assembly 40, with the banner mast base 31 and post 41 in cross section.

Figure 7:
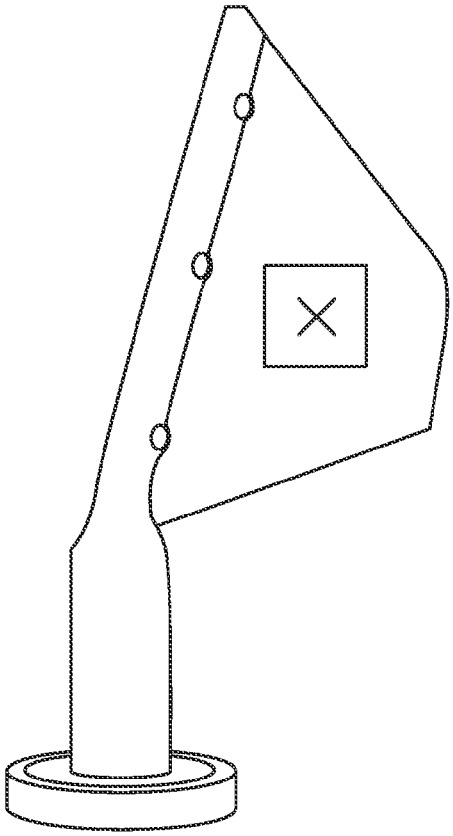
Figure 8:
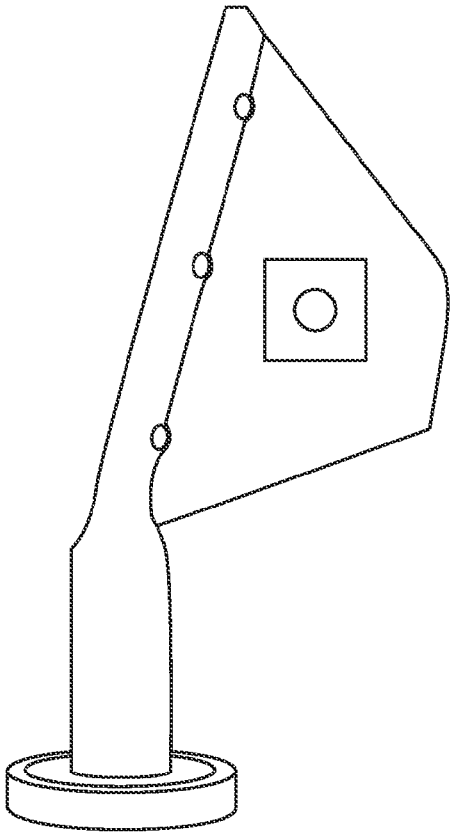

FIGS. 7 and 8 are perspective views of exemplary banner assemblies 10 with different exemplary collegiate logos.

Figure 9:
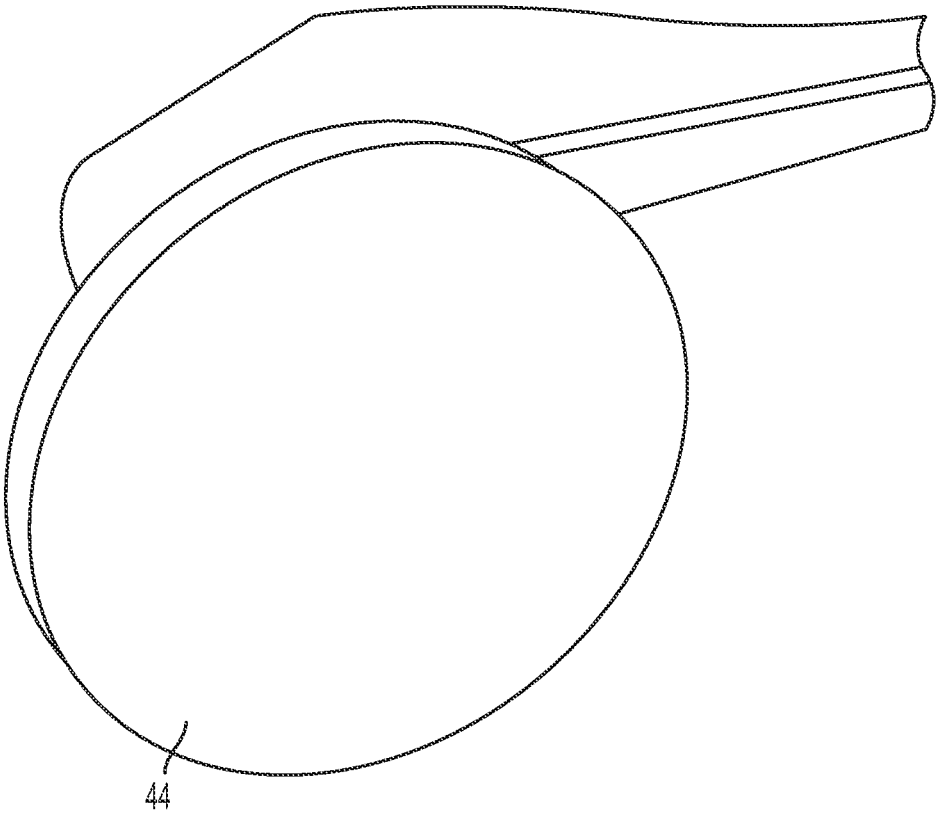

FIG. 9 is a photograph of the bottom face of the base assembly 40 of the banner assembly 10 of the first exemplary embodiment of the present invention, showing the protective label 44.

Figure 10:
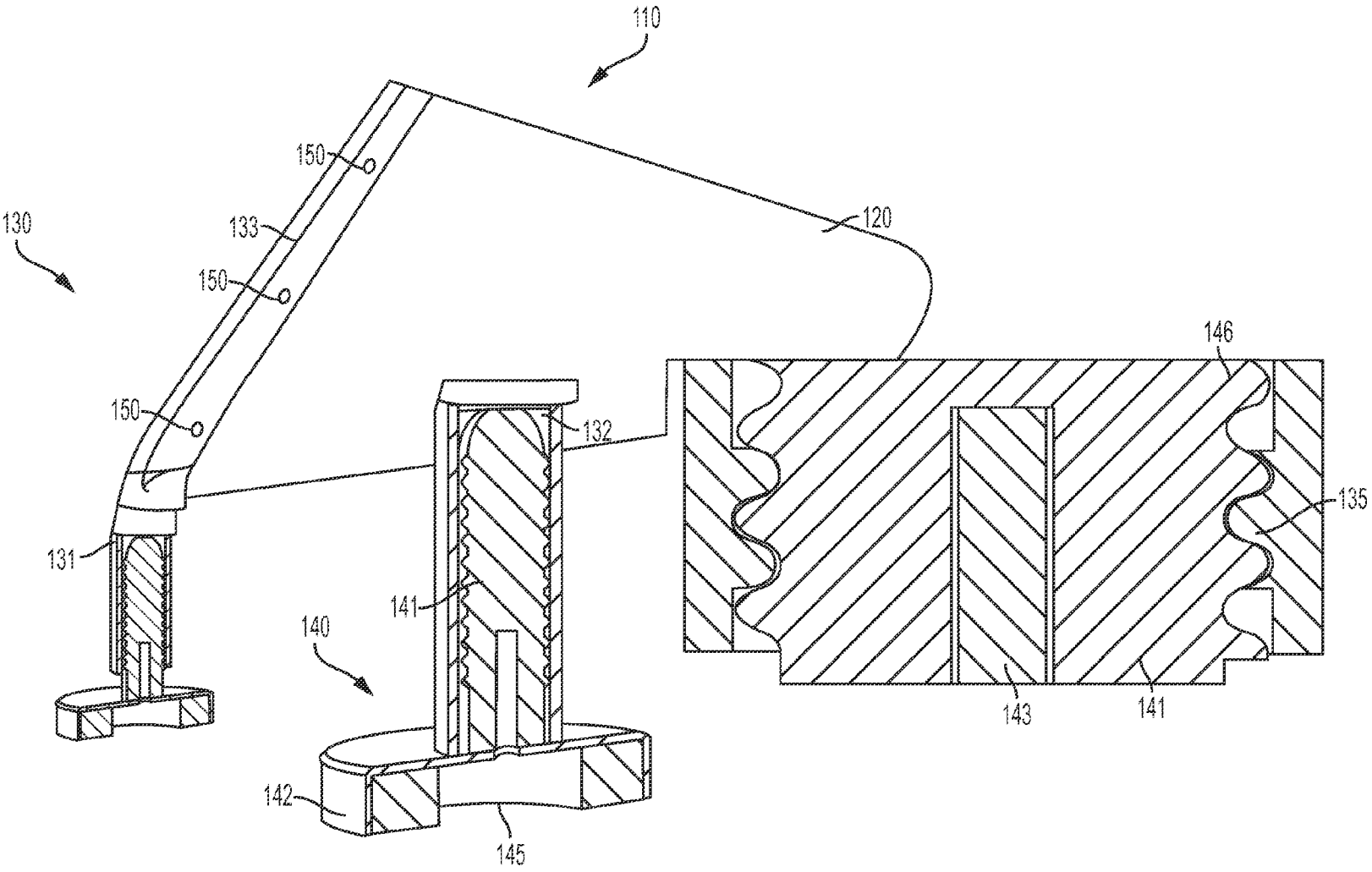

FIG. 10 is a series of exploded perspective views of a banner assembly 110 according to a second exemplary embodiment of the present invention.

Figure 11:
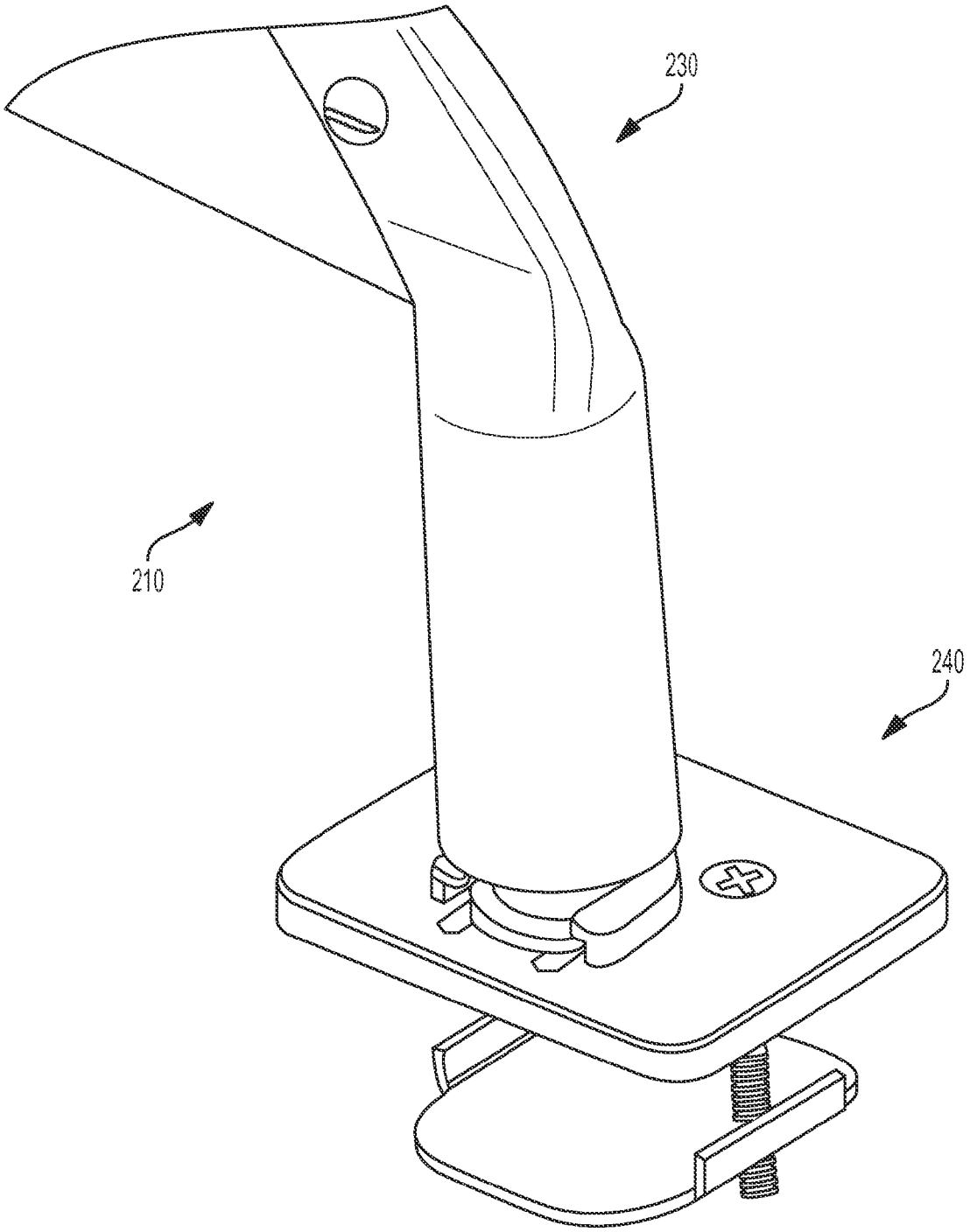

FIG. 11 is a partial, side perspective view of a portion of a banner assembly 210 according to a third exemplary embodiment of the present invention.

Figure 12:
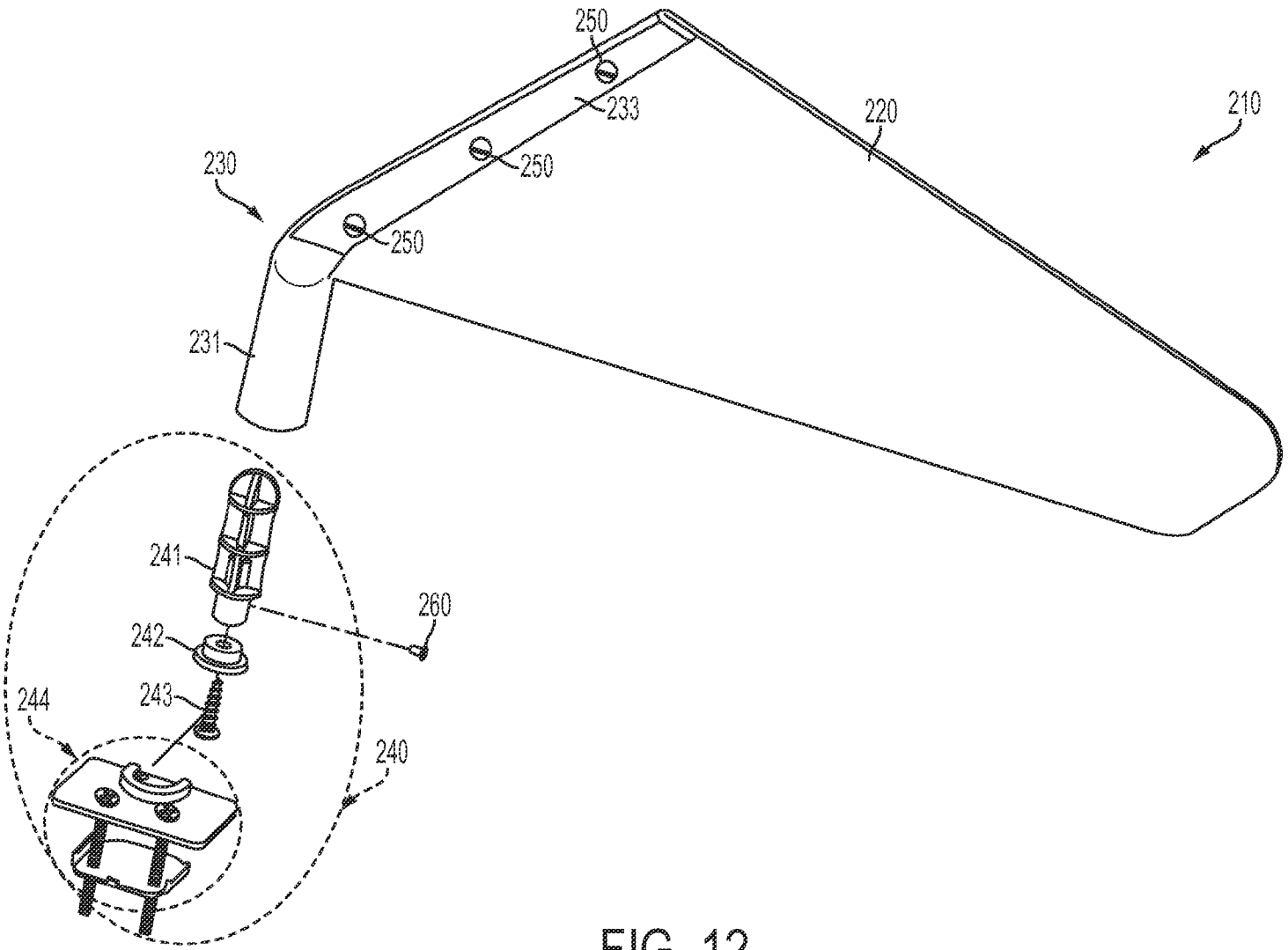

FIG. 12 is an exploded perspective view of the banner assembly 210 according to the third exemplary embodiment of the present invention.

Figure 13:
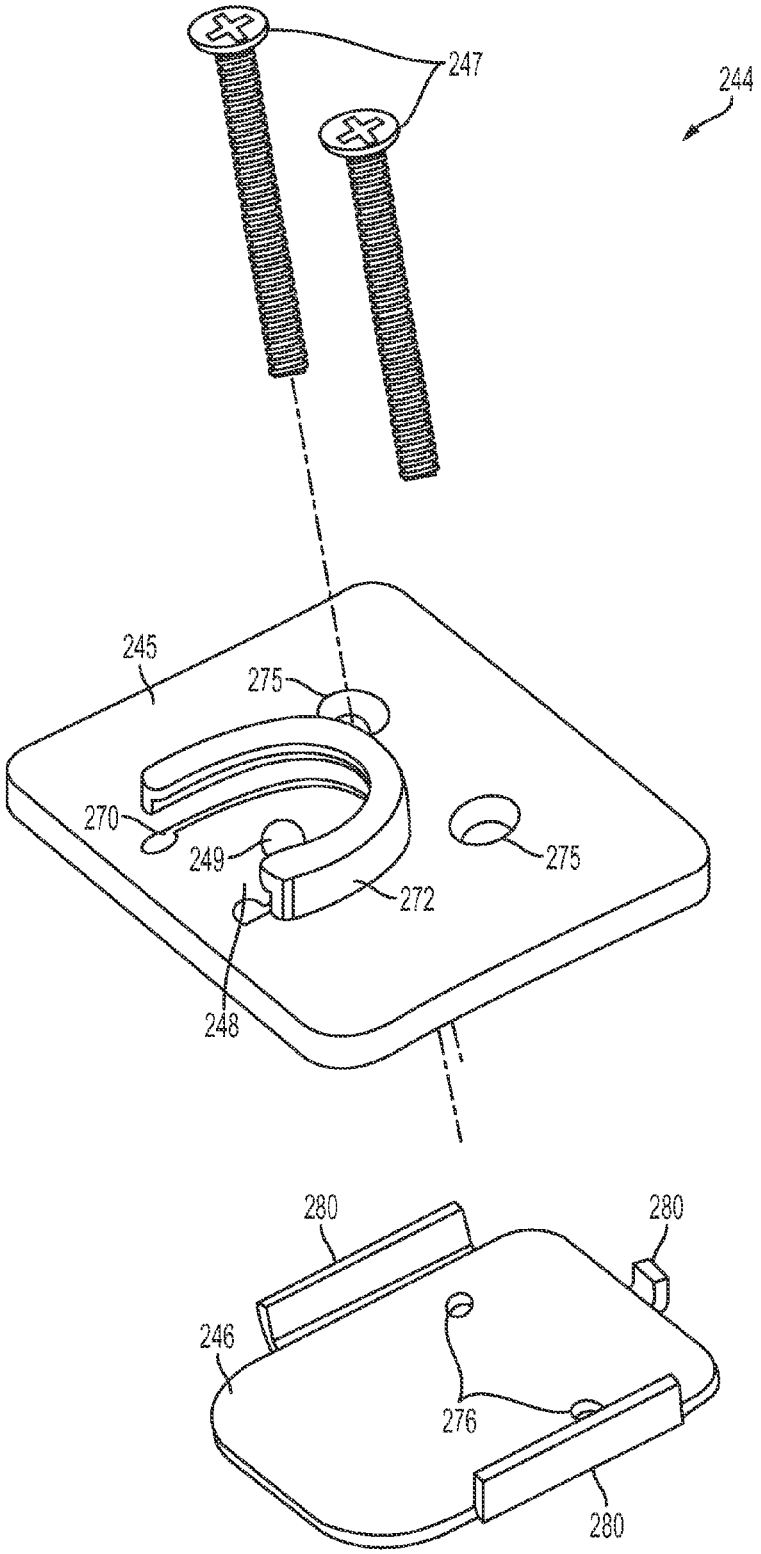

FIG. 13 is an exploded perspective view of a base assembly 244 according to the third exemplary embodiment of the present invention.

Figure 14:
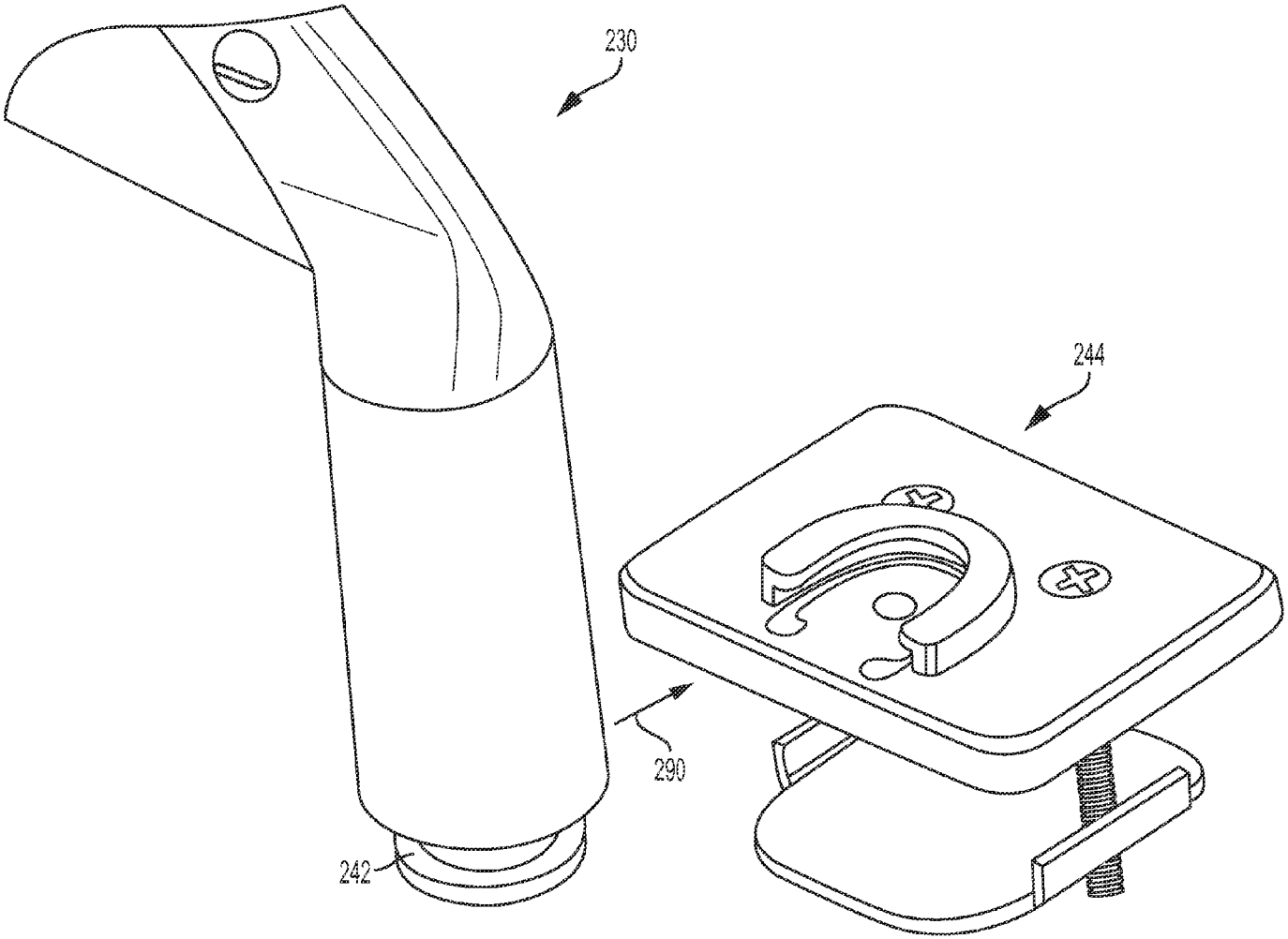

FIG. 14 is a partial, side perspective view of a portion of the banner assembly 210 according to the third exemplary embodiment of the present invention, showing the relative mounting movement in the direction of arrow 290 for purposes of fixedly attaching a banner mast 230 relative to the base assembly 244.

Figure 15:
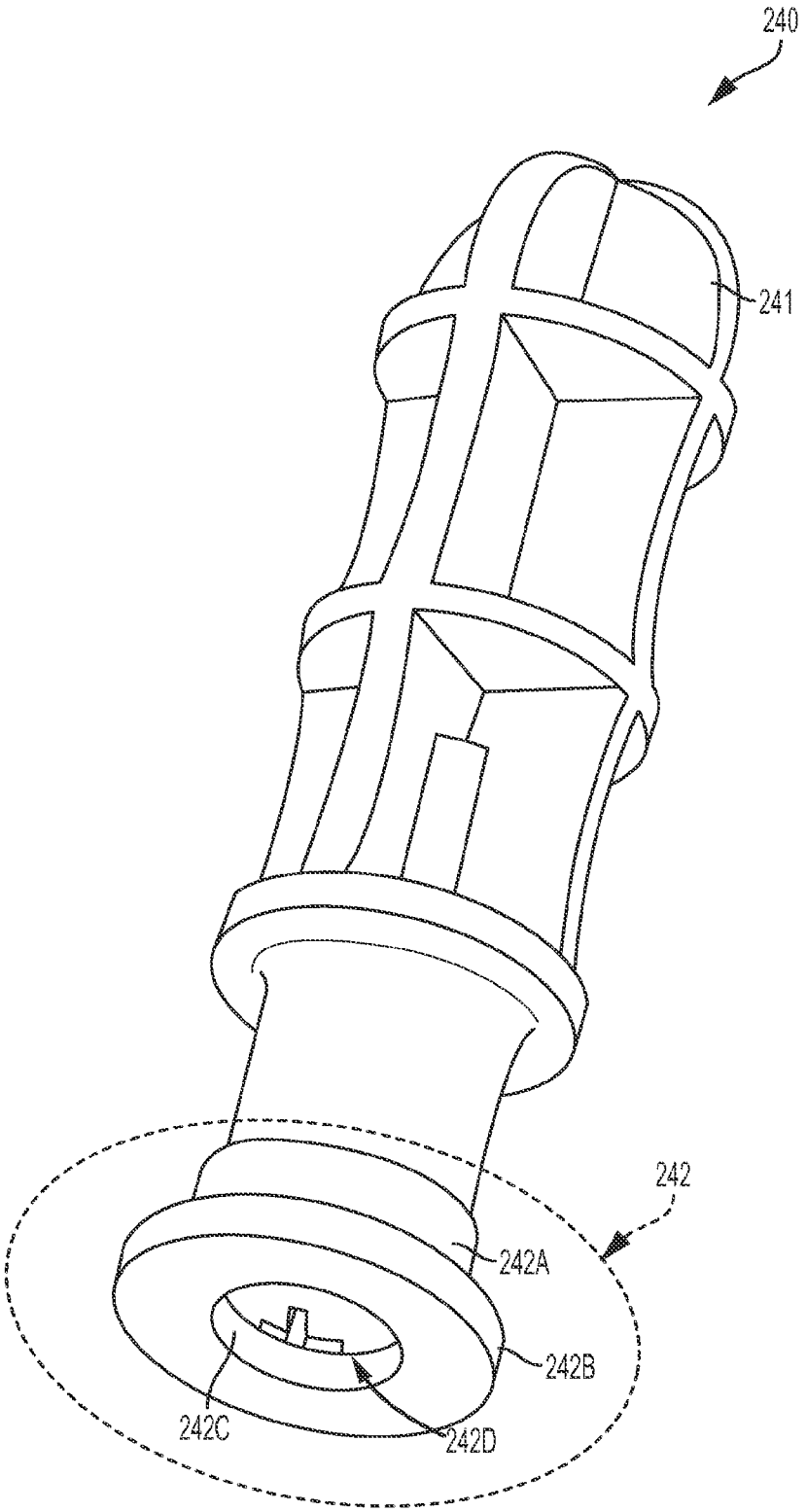

FIG. 15 is a side perspective view of a post 241 and an adapter 242 according to the third exemplary embodiment of the present invention.

Figure 16:
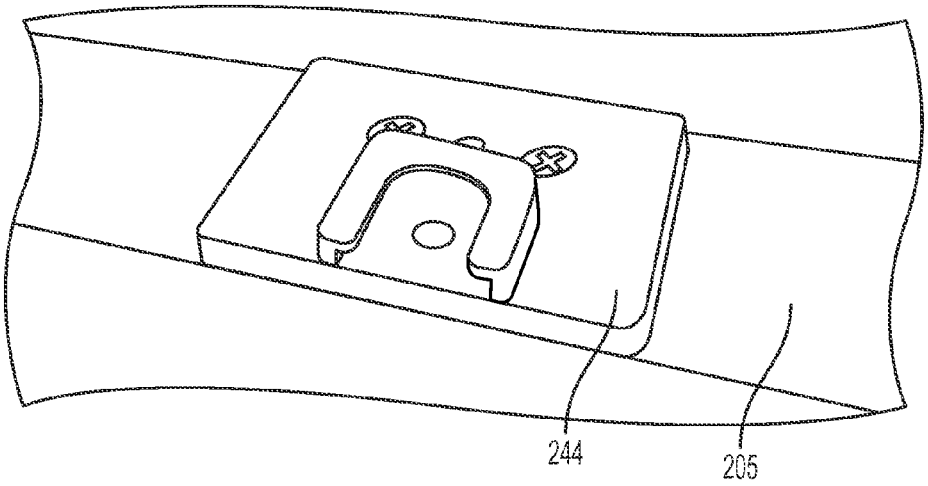
Figure 17:
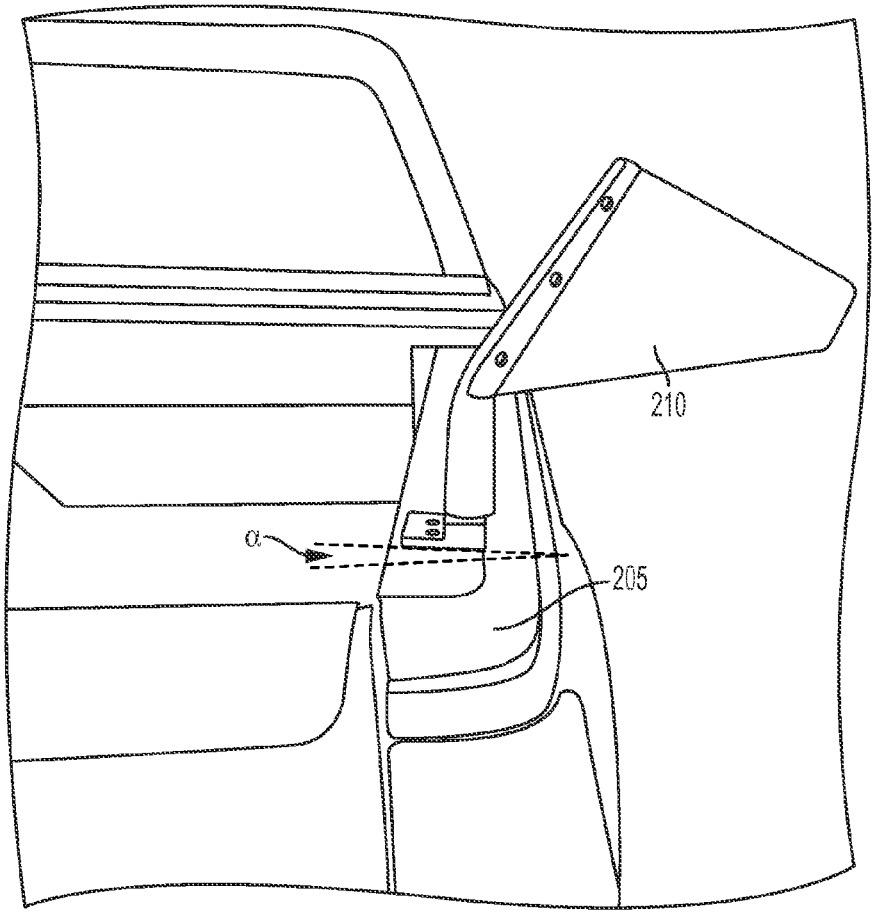

FIGS. 16 and 17 are photographs of the banner assembly 210 according to the third exemplary embodiment of the present invention, as may be mounted relative to a vehicle surface 205, regardless of whether the vehicle surface is purely horizontally oriented or angled relative to a horizontal axis.

DETAILED DESCRIPTION OF VARIOUS EMBODIMENTS

Various embodiments of the present invention now will be described more fully hereinafter with reference to the accompanying drawings, in which some, but not all embodiments of the inventions are shown. Indeed, the invention may be embodied in many different forms, combinations, and sub-combinations, and should not be construed as limited to those particular embodiments set forth herein; rather, these embodiments are provided so that this disclosure will satisfy applicable legal requirements. Like numbers refer to like elements throughout.

General Summary

Various embodiments comprise a banner or flag designed to mount on an automobile for displaying sports teams, brands, or affiliations, where the banner or flag is made of a hard material that self-aligns with the airflow, does not flap, and is therefore easily readable at all times (even at 0 mph travelling speed).

At least one embodiment comprises a banner panel of a rigid or semi-rigid flag material, a banner mast, a magnetic base assembly, and various fasteners. The flag is fixed to the banner mast, which defines at its bottom an elongate mast cavity (typically downwardly oriented when in use). The elongate mast cavity is configured to accept an elongate post that is part of a base assembly (typically upwardly oriented when in use). The elongate post is configured to pivot within the elongate mast cavity about the substantially aligned longitudinal axes of the elongate mast cavity and the elongate post.

According to various embodiments, the mast is fixedly positioned and/or mounted relative to the magnetic base assembly; however, the mast can freely pivot about the post that is accepted within the elongate mast cavity. In certain embodiments, a toothed configuration for engagement between the post and the mast is provided. In other embodiments, a selectively detachable mounting assembly may be provide, via which the mast can be easily removable from the base assembly when desired and also fixedly attached thereto when not selectively released.

According to various embodiments, the elongate post is part of a base assembly configured to be detachably attached to a suitable vehicle surface, such that the post is held substantially rigidly relative to the vehicle. In certain embodiments the base assembly may be magnetically-based. In other embodiments, the base assembly may be configured for mounting via a pair of plates about a relatively flat surface of a vehicle (e.g., an edge of a truck bed). In such embodiments, the base assembly may be a "stake-hole" configuration comprising a spring and ball interface. Such interface in these and still other embodiments is configured to engage and substantially lock with a screw head within an adapter between the elongate post and the base assembly, such that an associated mast is locked and/or fixedly positioned relative to the base assembly. In this manner, the freely pivoting of the elongate post within the elongate mast cavity may still be provided, but the fixed positioning and/or mounting and/or locking of the post relative to the base assembly may vary across various embodiments.

Element List

First Exemplary Embodiment

5 Vehicle Surface
10 Overall Banner Assembly
- 20 Banner panel
  - 21 Panel Upper Edge
  - 22 Panel Lower Edge
  - 23 Panel Trailing Edge
  - 24 Panel Leading Edge (exploded)
  - 25 Panel Logo (exemplary)
- 30 Banner Mast
  - 31 banner mast base
  - 32 elongate cavity
  - 33 banner mast flange
  - 34 elongate slot
  - 35 angled leading edge
- 40 Magnetic Base Assembly
  - 41 Post
  - 42 Magnet Subassembly
  - 43 Screw
  - 44 Protective Label
  - 45 Protective Boot
- 50 Panel Mount Rivets (aka Plastic Binding Posts)
- 60 Mast Retention Rivet Second Exemplary Embodiment

110 Overall Banner Assembly
- 120 Banner panel
- 130 Banner Mast
  - 131 banner mast base
  - 132 elongate cavity
  - 133 banner mast flange
  - 135 banner mast threads
- 140 Magnetic Base Assembly
  - 141 Post
  - 142 Magnet Subassembly
  - 143 Screw
  - 145 Protective Boot
  - 146 Post Threads
- 150 Panel Mount Rivets (aka Plastic Binding Posts)

Third Exemplary Embodiment

205 Vehicle Surface
210 Overall Banner Assembly

220 Banner panel
230 Banner Mast
231 banner mast base
233 banner mast flange
240 Base Assembly
241 Post
242 Adapter
242A Tower Portion
242B Base Portion
242C Recess Portion
242D Central Orifice
243 Screw
244 Stake Hole Mount Assembly
245 Top Part
246 Bottom Part
247 Fasteners
248 Spring Portion
249 Ball Portion
270 Elongate Orifice
272 Elongate Guard Portion
275 Top Part Fastener Holes
276 Bottom Part Fastener Holes
280 Bottom Part Alignment Tabs
250 Panel Mount Rivets (aka Plastic Binding Posts)
260 Mast Retention Rivet
290 Direction of Movement for Stake Hole Mount Engagement Detailed Discussion of First Embodiment 10

General Construction of Embodiment 10

Figure 1:
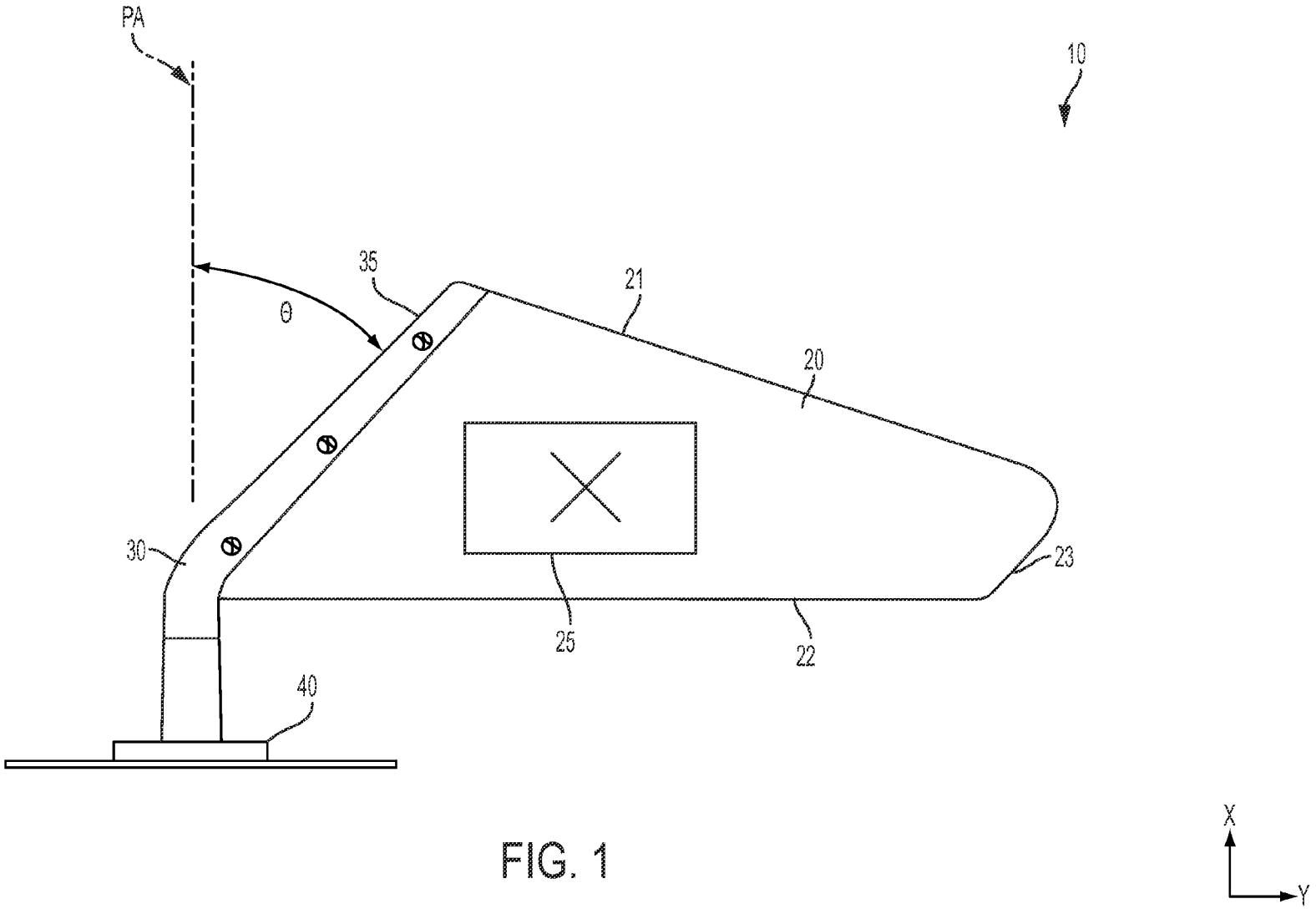
FIG. 1 is a side elevational view of an exemplary banner assembly 10 according to a first exemplary embodiment of the present invention. This figure shows the assembly in "normal use" atop a substantially horizontal supporting surface, with pivot axis PA being substantially vertical.

According to various embodiments, with reference to FIG. 1, the overall banner assembly 10 comprises:

Banner Panel 20
Banner Mast 30
Magnetic Base Assembly 40 (including a post 41)
Panel Mount Rivets 50
Mast Retention Rivet 60

According to various embodiments, with continued reference to FIG. 1 and also reference to FIG. 4, the banner panel 20 is fixed to the banner mast 30, which defines an elongate mast cavity 32 (discussed below, typically downwardly oriented when in use). The elongate mast cavity 32 is configured in certain embodiments to accept an elongate post 41 (typically upwardly oriented when in use; see FIG. 4) which is part of the magnetic base assembly 40, and configured to pivot within the elongate mast cavity 32 about the substantially aligned longitudinal axes of the elongate mast cavity and the elongate post 41.

In certain embodiments, the banner mast 30 is fixed to the magnetic base assembly 40; however, the mast 30 can freely pivot about the post 41, as will be described in further detail below.

According to various embodiments, the elongate post 41 is substantially rigidly fixed as part of the magnetic base assembly 40, which is configured to be detachably attached to a suitable vehicle surface 5, as will also be described in further detail below.

Banner Panel 20

According to various embodiments and with continued reference to FIG. 1, the banner panel 20 is configured to be at least "semi-rigid,"—that is, rigid enough to maintain a generally planar configuration when stationary and when subjected to movement.

The banner panel 20 in at least the illustrated embodiment comprises a panel upper edge 21, a panel lower edge 22, a panel trailing edge 23, and a panel leading edge 24. According to various embodiments, the banner panel 20 also comprises two primary planar sides, each configured to display an exemplary panel logo 25, as illustrated in FIGS. 1 and 7-8.

Figure 4:
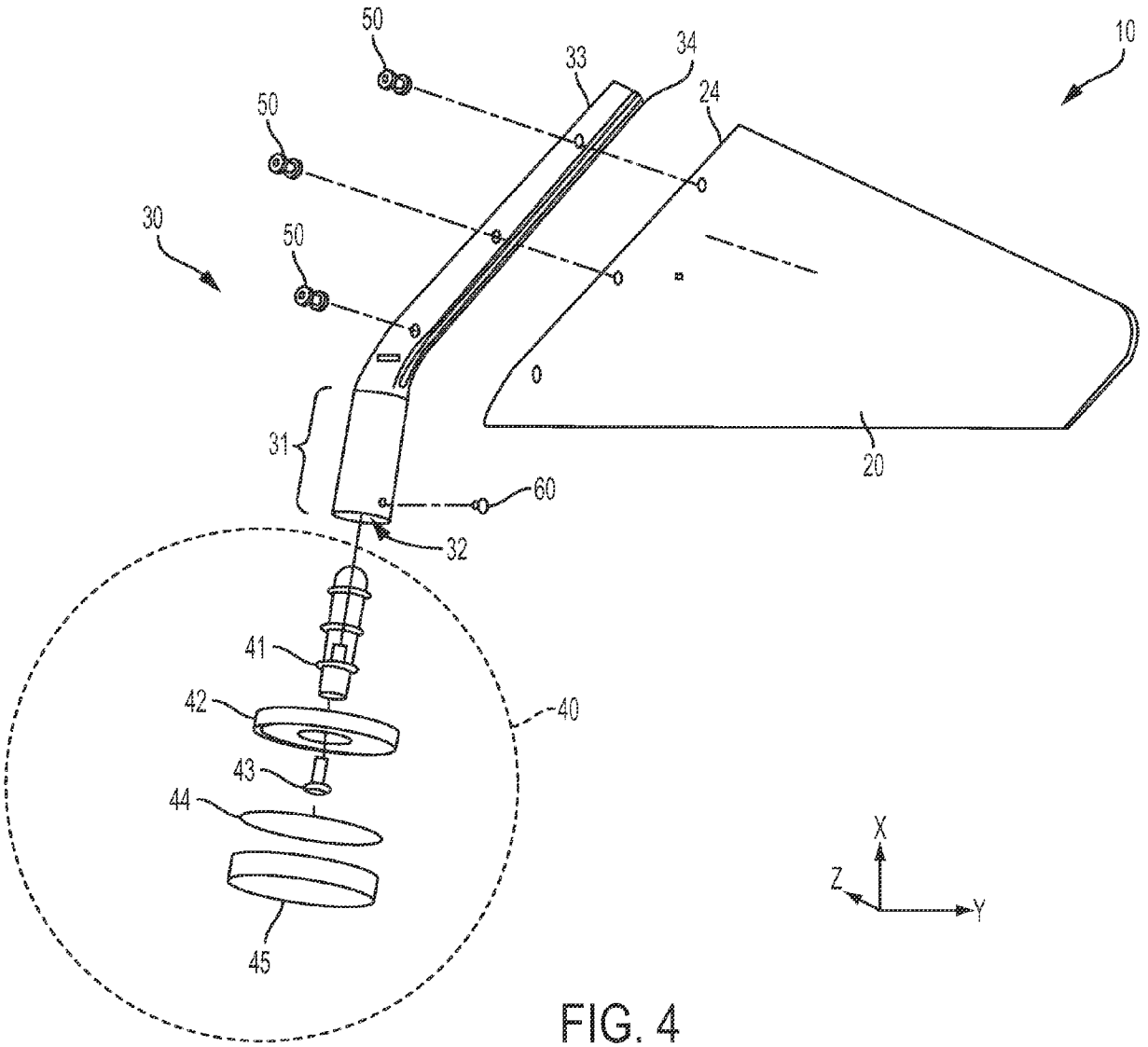
FIG. 4 is an exploded perspective elevational view of the banner assembly 10 according to the first exemplary embodiment of the present invention.

According to various embodiments, with reference now particularly to FIG. 4, the leading edge 24 of the banner panel 20 is configured to fit within an elongate groove or slot 34 defined by the banner mast 30. In this manner, the banner panel 20 may be selectively removed from the banner mast 30, for example if a different banner panel is desired for purposes of interchangeability. Selective interchangeability of two or more banner panels 20 relative to the banner mast 30 and via the slot 34 is, in certain embodiments, further facilitated by a combination of the slot and a plurality of fasteners such as panel mount rivets 50 as discussed elsewhere herein. Any sort of fasteners may be envisioned, as should be considered within the scope of the present disclosure.

Note that in certain exemplary and non-limiting embodiments the banner panel 20 is made of corrugated plastic such as used in yard signs. In one such exemplary embodiment, the panel 20 includes 4 mm-thick corrugated plastic, being extruded twin-wall plastic-sheet produced from high-impact polypropylene resin. In these and still other embodiments, the panel 20 may thus have two exterior walls with internal ridges (flutes) separating the two walls. In these and still other embodiments, the corrugated plastic can be screen-printed or configured to accept digital printing thereupon, for example for purposes of embedding thereon one or more logos or informational materials, as described elsewhere herein. Exemplary and non-limiting trade names of such corrugated plastic material include Coroplast, Twinplast, Corflute, Polyflute, Intepro, and Proplex, although other types of corrugated plastic material and still further other types of material (plastic and non-plastic alike) are contemplated without departing from the spirit and scope of the present invention, provided such possess material characteristics for sufficient rigidity of the panel 20, as previously detailed herein.

With reference to FIG. 1, it should be understood that the orientation of the panel upper edge 21, the panel lower edge 22, the panel trailing edge 23, the panel leading edge 24 (visible in FIG. 4) are such that a substantially elongated triangular shape is formed, which shape defines the banner panel 20 in its entirety. According to various embodiments, the panel trailing edge 23 may provide some degree of rounded curvature, as compared to a sharp pointed edge of what is conventionally understood to exist in a triangularly-shaped structure. Of course, any of a variety of alternative shapes and/or sizes of the banner panel 20 may be provided with the scope and spirit of the present disclosure, provided all have a leading edge 24 that is configured to engage and/or otherwise interlock with the banner mast flange 33 of the banner mast 30, as will be described in turn below.

It should also be understood that, although not numbered in FIG. 4, the banner panel 20 may comprise a plurality or a set of holes formed therein and there-through, substantially adjacent the leading edge 24. Such holes are according to various embodiments configured and sized so as to substantially receive one or more fasteners such as the illustrated panel mount rivets 50 or any comparable or commonly known and understood fasteners, as may be desirable for use in certain applications.

Banner Mast 30

According to various embodiments, the banner mast 30 comprises a banner mast base 31 and a banner mast flange 33.

With continued reference to FIGS. 1-4, the banner mast base 31 is in one embodiment substantially elongate and cylindrical, and comprises a lower elongate cavity 32 (see FIG. 4) configured to pivotably accept a post 41, as will be discussed later. In certain embodiments, the banner mast base 31 may be slightly tapered outwardly towards the end including the cavity 32, in which instances the cavity 32 is likewise so slightly tapered. In other embodiments, tapering may not be present, as may be desirable according to certain scenarios.

According to various embodiments, the banner mast flange 33 extends generally outwardly and upwardly (when mounted) from one end of the banner mast base 31 and includes along substantially the length thereof slot 34. In certain embodiments, the slot 34 is along one edge of the flange 33 and is configured to cooperate with panel mount rivets 50 to slidably capture and subsequently retain (e.g., immobilize) the leading edge 24 of the banner panel 20 relative to the banner mast flange 33, as may be understood with reference to FIGS. 1 and 4 in combination.

According to various embodiments, both the banner mast base 31 and the banner mast flange 33 are elongate, and as such include respective longitudinal axes. In certain embodiments, the respective longitudinal axes are not parallel relative to one another, but diverge relative to one another at an acute angle Θ as shown in FIG. 1. In at least one embodiment, the angle Θ from pivot axis is approximately 45 degrees. In other embodiments, the angle Θ from pivot axis lies in a range of approximately 40 to 50 degrees. In still other embodiments, the angle Θ from pivot axis lies in a range of approximately 35 to 55 degrees. In yet still other embodiments, the angle Θ from pivot axis may be any angle greater than zero degrees and less than ninety degrees, as for at least the zero degree orientation, the overall banner assembly 10 tends to undesirably vibrate violently.

Figure 2:
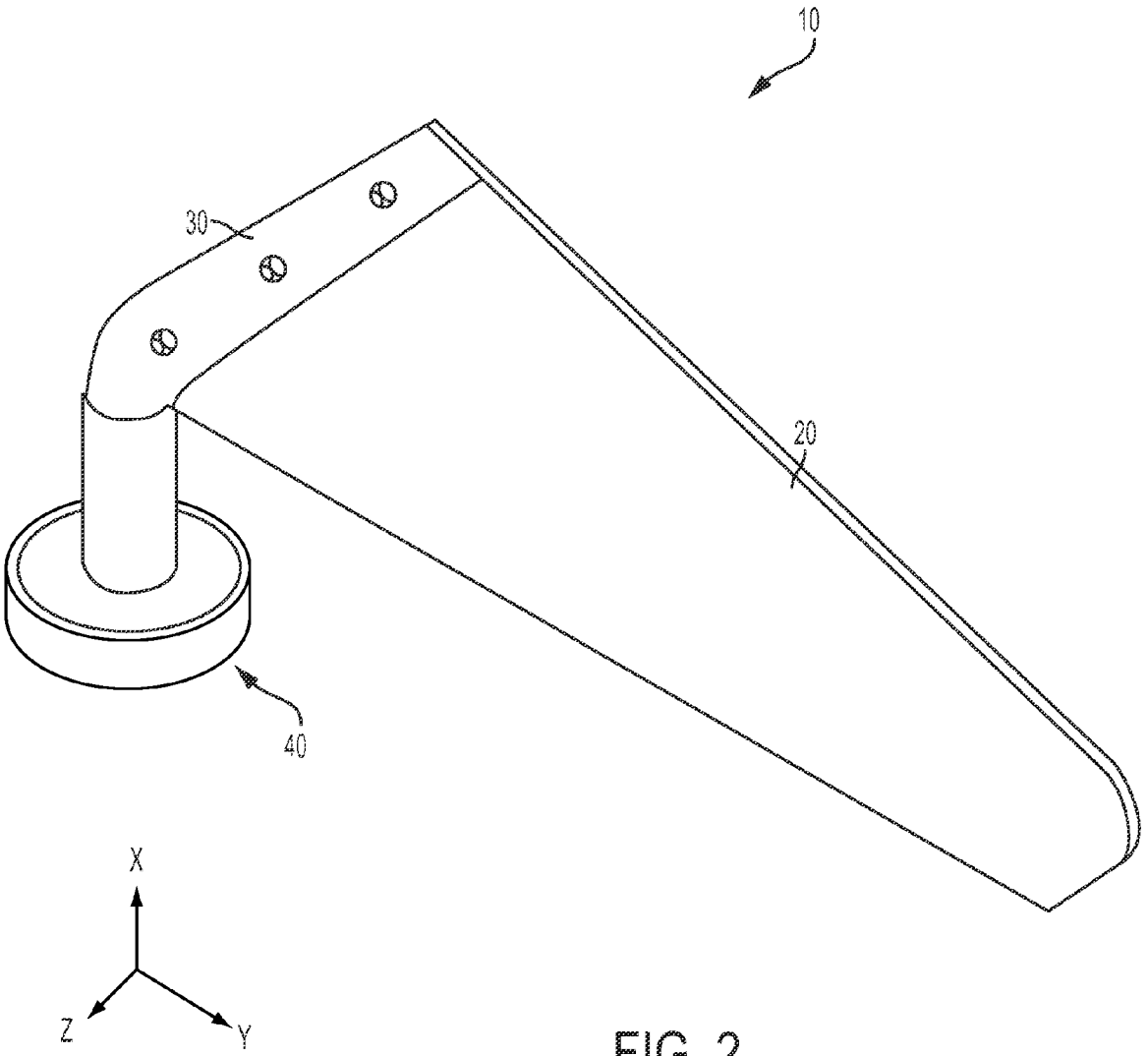
FIG. 2 is a generally overhead perspective view of the banner assembly 10 according to the first exemplary embodiment of the present invention.
Figure 3:
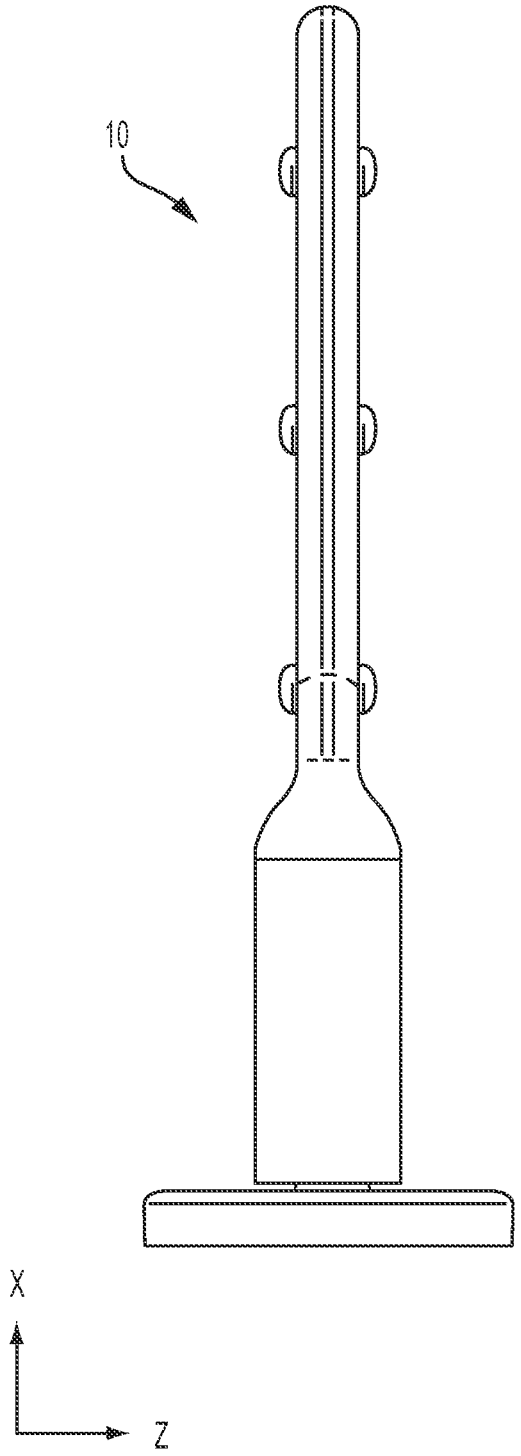
FIG. 3 is a side elevational view of the banner assembly 10 according to the first exemplary embodiment of the present invention.

According to various embodiments, the banner mast flange 33 may comprise an angled leading edge 35 that is not only angled at the acute angle Θ relative to the mast base 31 but also angled relative to opposing sides thereof, such that a tapered leading edge is formed, expanding progressively outwardly toward the connection thereof adjacent the banner panel 20, all as may be understood with reference to at least FIG. 2. In this manner, vibration may be further minimized due to an improved aerodynamic structure at the angled leading edge 35, which may further decrease turbulence imposed upon the assembly 10 as a whole as a result of airflow passing thereover.

Magnetic Base Assembly 40

According to various embodiments, with continued reference to FIG. 4, it may be seen that the magnetic base assembly 40 generally comprises a post 41, a magnet subassembly 42, a screw 43, and a protective label 44. In certain embodiments, the assembly 40 may also include a protective boot 45, as may be desirable for certain applications.

The post 41 is generally of unitary construction, is elongate, and includes a hole (see also FIG. 6) in one end, which is its "bottom" end when in normal use.

The magnet subassembly 42 is according to various embodiments of multiple part construction, and generally comprises a ring-shaped magnet adhesively attached within the cavity of a round, downwardly-directed cap, which includes a hole in its axial center.

The screw 43 is configured according to various embodiments such that it may be extended through the hole in the cap and in so doing engage the bottom hole of the post 41, as may be also understood with combined reference to FIGS. 4 and 6. In this manner, the screw 43 is configured to facilitate attachment of the magnet subassembly 42 to the underside of the post 41.

According to various embodiments, the protective label 44 is configured to be adhesively attached to the underside of the magnet subassembly 42, so as to reduce the opportunity for scratch or other damage when the magnetic base assembly is attached to a vehicle surface. It should be understood that certain embodiments may dispense with the protective label 44, as may be desirable for some applications.

If desired, according to various embodiments, a protective cap-like boot 45 may additionally and/or alternatively be used. Generally speaking, in certain embodiments, the boot 45 comprises an upwardly-directed cavity which would accept the magnet subassembly 42.

When assembled, the magnetic base assembly 40 is configured to be magnetically attached to a suitable metal surface 5 of a vehicle such as shown in FIG. 1, such that its included post 41 is rigidly supported in a substantially vertical or upright position.

Once assembled, it should be understood that the magnetic base assembly 40 of FIG. 4 according to various embodiments has no internally moving parts relative to one another.

Panel Mount Rivets 50

According to various embodiments, panel mount rivets 50 are used to attach the leading edge 24 of the banner panel 20 within the slot 34 of the banner mast flange 33. Corresponding holes in the flange 33 and the banner panel 20 facilitate such attachment. Three are shown in for example FIG. 4, but other numbers could be used without departing from the spirit and scope of the present invention.

Still further, although rivets 50 are illustrated, any of a variety of types and sizes of fasteners, as commonly known and understood to exist in the art may be used, as may be desirable or necessary for specific applications, without departing from the spirit and scope of the present disclosure.

Mast Retention Rivet 60

According to various embodiments, the mast retention rivet 60 is configured to prevent the banner mast base 31 from becoming axially detached from the post 41 of the magnetic base assembly, while at the same time still allowing the banner mast base 31 to rotate or pivot about pivot axis PA. This rivet may be configured for easy installation or removal and may be configured according to various embodiments much like a "set-screw," with such features as such are commonly known and understood in the art to involve.

General Operation and Features of Embodiment 10

According to various embodiments, the banner assembly 10 is configured to attach to a metallic vehicle surface such as 5 (e.g. a roof or trunk lid). Via a metallic surface, the magnetic base assembly 40 is fixed to the surface 5, thus fixing the banner mast 30 and the banner panel 20 and thus the entire banner assembly 10 relative to the surface, but for the pivoting of at least the banner mast 30 about pivot axis PA (see FIG. 1).

As previously described, at least some angle Θ greater than zero of the mast and/or mast flange 33 relative to pivot axis PA improves aerodynamics at least in part by reducing the pressure drag force imposed upon the banner panel 20.

Materials of Embodiment 10

Materials with a low coefficient of friction were chosen to allow the mast to spin freely around the post. These materials are also wear resistant to increase the life of the parts over repeated movements. Exemplary materials include Polyoxymethylene (POM) (commonly known as Acetal) which is an engineering thermoplastic; Tradenames include Delrin, Celcon, and Hostaform. One embodiment includes the use of Delrin 527UV (a UV-resistant version of Delrin). Still other embodiments may include the use of Nylon (e.g., Zytel or specifically Zytel PA66) as post material 41 to at least in part reduce noise. In certain embodiments mast 30 formed from Delrin 527UV positioned against post 41 of Zytel results in less squeaking or comparable noise as compared to two adjacently positioned components both made of Delrin 527UV. However, other suitable materials and/or combinations of material may be substituted without departing from the spirit and scope of the present invention.

A rigid or semi-rigid flag material allows the mast-flag assembly to self-align with the wind. Durability is also improved since the violent flapping of a cloth flag is reduced or eliminated.

Detailed Discussion of Second Embodiment 110

According to various embodiments, with reference to FIG. 10, the overall banner assembly 110 comprises:

Banner Panel 120

Banner Mast 130

Magnetic Base Assembly 140 (including a post 141)

Panel Mount Rivets 150

According to various embodiments, with continued reference to FIG. 10 and also with reference to FIGS. 1-4 (illustrating assembly 10), it should be understand that the respective components of assembly 110 are substantially the same in shape, size, orientation, material composition, and the like, as that found in corresponding components of assembly 10. Indeed, according to certain embodiments, the only distinguishing feature between assemblies 10 and 110 lies in the substitution of the mast retention rivet 60 in assembly 10 with a "screw" configuration in assembly 110.

According to various embodiments, this "screw" configuration comprises counter-acting threads 146 defined and formed on the post 141 and threads 135 defined and formed on the banner mast 131. In certain embodiments, a fewer number of threads 135 are provided on the banner mast 131 relative to the number of threads 146 provided on the post 141, such that upon "complete" screwing of the post into the mast cavity 132, all of the threads 146 are internal to the cavity and past all of the threads 135 of the mast 130. In this manner, once mounting is complete, the only way to subsequently remove the mast 130 from the base assembly 140 is to actively pull them apart relative to one other sufficiently so as to re-engage the respective threads 135, 146. As a result, absent such opposing forces, the threaded "screw" configuration of the illustrated embodiment of FIG. 10 provides an interlocked configuration during use thereof.

As mentioned, other than the inclusion of threads 135, 146 and the dispensing with a mast retention rivet 60 (e.g., as in assembly 10), it should be understood that according to various embodiments, the remainder of the features of assembly 110 are substantially the same as those described previously herein with respect to assembly 10. With continued reference to FIG. 10, as non-limiting examples, the banner mast 130 and its base 131, cavity 132, and flange 133 may be substantially the same as the banner mast 30 and its base 31, cavity 32, and flange 33, as described previously herein. Similarly, the illustrated magnetic base assembly 140 and its post 141, magnet subassembly 142, screw 143, and protective boot 145 may be substantially the same as the magnetic base assembly 40 and its post 41, magnet subassembly 42, screw 43, and protective boot 45, as described previously herein.

Of course, in other embodiments, one or more of these components of assembly 110 may be substantially different relative to those corresponding components of assembly 10; for example, the magnetic base assembly 140 may instead be substantially the same as base assembly 240 of banner assembly 210, as will be described in turn below. In this regard, it should be understood that any respective components of any of the embodiments described herein may be interchangeably incorporated into a new and distinct embodiment, as may be desirable for certain applications and as may be considered within the spirit and scope of the present invention in view of the merely exemplary and non-limiting embodiments described herein.

As with embodiments of assembly 10, for the various embodiments of assembly 210, materials with a low coefficient of friction were chosen to allow the mast to spin freely around the post. These materials are also wear resistant to increase the life of the parts over repeated movements. Exemplary materials include Polyoxymethylene (POM) (commonly known as Acetal) which is an engineering thermoplastic; Tradenames include Delrin, Celcon, and Hostaform. One embodiment includes the use of Delrin 527UV (a UV-resistant version of Delrin). Still other embodiments may include the use of Nylon (e.g., Zytel or specifically Zytel PA66) as post material 141 to at least in part reduce noise. In certain embodiments mast 130 formed from Delrin 527UV positioned against post 141 of Zytel results in less squeaking or comparable noise as compared to two adjacently positioned components both made of Delrin 527UV. However, other suitable materials and/or combinations of material may be substituted without departing from the spirit and scope of the present invention.

A rigid or semi-rigid flag material allows the mast-flag assembly to self-align with the wind. Durability is also improved since the violent flapping of a cloth flag is reduced or eliminated.

Detailed Discussion of Third Embodiment 210

General Construction of Embodiment 210

According to various embodiments, with reference to FIGS. 11 and 12, the overall banner assembly 210 comprises:

Banner Panel 220

Banner Mast 230

Magnetic Base Assembly 240 (including a post 241)

Panel Mount Rivets 250 (see FIG. 12)

Mast Retention Rivet 260 (see FIG. 12)

According to various embodiments, with continued reference to FIGS. 11-12, the banner panel 220 is fixed to the banner mast 230, which defines an elongate mast cavity 232 (not shown, but understandable via analogy to mast cavity 32 of assembly 10, as illustrated in FIG. 4 and described previously herein). With reference by analogy to cavity 32, according to various embodiments the elongate mast cavity 232 is configured in certain embodiments to accept an elongate post 241 (typically upwardly oriented when in use; see FIG. 12) which is part of the base assembly 240, and configured to pivot within the elongate mast cavity 232 about the substantially aligned longitudinal axes of the elongate mast cavity, the mast base 231, and the elongate post 241.

In certain embodiments, the banner mast 230 is fixed to the base assembly 240; however, the mast 230 can freely pivot about the post 241. With reference specifically to FIG. 12, it may be understood that such pivoting is facilitated via the mast retention rivet 260, which is configured substantially similar to rivet 60 of assembly 10 (as previously described herein), such that the rivet 260 passes through an opening in the mast base 231 when such is positioned substantially adjacent the post 241. Such may be understood with reference to the lead lines of FIG. 12, illustrating the connectivity between the rivet 260 and the post 241.

According to various embodiments, the elongate post 241 is substantially rigidly fixed as part of the base assembly 240, which is configured to be detachably attached to a suitable vehicle surface 5, as will also be described in further detail below. In certain embodiments, however, the elongate post 241 may be freely pivotable relative to the base assembly 240, as facilitated at least in part via the spring 248 and ball 249 configuration provided thereby, as illustrated in FIG. 13 and described further below. Generally speaking, the ball 249 may be configured according to various embodiments to snap into a screw head 243 and lock therein via a tension imposed thereupon by the spring 248. In this manner, at least an adapter portion of the post to the base assembly 240. Additional details in this regard will be provided further below.

Banner Panel 220

According to various embodiments and with continued reference to FIGS. 11-12, the banner panel 220 is configured to be at least "semi-rigid,"—that is, rigid enough to maintain a generally planar configuration when stationary and when subjected to movement. In certain embodiments, the banner panel 220 is configured substantially the same in at least one of size, shape, material, and the like as the banner panels 20 and/or 120, as previously described herein. Of course, it should be understood that one or more components of the banner panel 220 may be substantially different relative to those corresponding components of either banner panel 120 or panel 20, however as may be desirable for particular applications, without departing from the scope or spirit of the present disclosure.

Indeed, according to various embodiments, the banner panel 220 illustrated in FIG. 12 comprises at least a panel upper edge, a panel lower edge, a panel trailing edge, and a panel leading edge. Although such are not expressly numbered in FIG. 12, it should be understood that according to various embodiments at least these components of banner panel 220 are substantially the same in at least one of size, shape, material, or the like, as the panel upper edge 21, the panel lower edge 22, the panel trailing edge 23, and the panel leading edge 24 of banner panel 20, which is illustrated in FIGS. 1 and 4. In certain embodiments, it should be further understood that the banner panel 220 and/or the banner panel 20 are further substantially the same as the banner panel 120, as previously described herein. Of course, it should also be understood that in other embodiments any one of the panel upper edge, the panel lower edge, the panel trailing edge, and/or the panel leading edge may substantially differ relative to one or more of the banner panel 120 and/or the banner panel 20 in at least one of size, shape, material composition, or the like, however as may be desirable for various applications.

Banner Mast 230

According to various embodiments and with continued reference to FIGS. 11-12, the banner mast 230 is configured to be substantially elongate and cylindrical, and comprises a lower elongate cavity 232 (not shown, but see by analogy cavity 32 of banner mast 30, as illustrated in FIG. 4) configured to pivotably accept a post 241, as will be discussed later. In certain embodiments, the banner mast base 231 may be slightly tapered outwardly towards the end including the cavity 232, in which instances the cavity 232 is likewise so slightly tapered. In other embodiments, tapering may not be present, as may be desirable according to certain scenarios.

According to various embodiments, the banner mast flange 233 extends generally outwardly and upwardly (when mounted) from one end of the banner mast base 231 and includes along substantially the length thereof slot 234 (not numbered, but understandable by analogy to slot 34 of banner mast flange 33, as illustrated in FIG. 4). In certain embodiments, the slot 234 is along one edge of the flange 233 and is configured to cooperate with panel mount rivets 250 to slidably capture and subsequently retain (e.g., immobilize) the leading edge 224 of the banner panel 220 relative to the banner mast flange 233, as may be understood with reference to FIG. 12 and by analogy to FIGS. 1 and 4 in combination.

According to various embodiments, both the banner mast base 231 and the banner mast flange 233 are elongate, and as such include respective longitudinal axes. In certain embodiments, the respective longitudinal axes are not parallel relative to one another, but diverge relative to one another at an acute angle Θ as may be understood by analogy to the illustration of the mast base 31 and the mast flange 33 of assembly 10 as shown in FIG. 1. In at least one embodiment, the angle Θ from pivot axis is approximately 45 degrees. In other embodiments, the angle Θ from pivot axis lies in a range of approximately 40 to 50 degrees. In still other embodiments, the angle Θ from pivot axis lies in a range of approximately 35 to 55 degrees. In yet still other embodiments, the angle Θ from pivot axis may be any angle greater than zero degrees and less than ninety degrees, as for at least the zero degree orientation, the overall banner assembly 210 (like assembly 10 and/or assembly 110) tends to undesirably vibrate violently.

According to various embodiments, the banner mast 230 as illustrated in FIG. 12 comprises various components (e.g., the base 231 and the flange 233 as non-limiting examples), which may be configured in size, shape, orientation, and/or material composition substantially the same as the banner mast 30 and/or the banner mast 130 (and their respective components). Of course, in still other embodiments, one or more components or features of the banner mast 230 may differ substantially from those corresponding components or features of the masts 30, 130, however as may be desirable for particular applications.

Base Assembly 240

According to various embodiments, it may be desirable or otherwise necessary to mount the post 241 of assembly 210 (or by analogy either of the posts 41 or 141 of assemblies 10 and 110) relative to a vehicle via the use of a base assembly 240 that would fit within a "stake hole" in the back of a pickup truck (not shown expressly, but understood with reference to FIGS. 11-12 and 16-17 in combination). As a non-limiting example, a user of the assembly 210 could use a toggle bolt to fasten the post to the truck bed's stake hole. The bolt could in certain embodiments have a rubber grommet to keep the bolt centered in the stake hole, thus keeping the post 241 not only stabilized but substantially vertically oriented. In these and still other embodiments, at least one of a metal or aplastic top plate larger in size than the stake hole could be fastened to the bottom of the post via a lockable engagement with the toggle bolt screw, as will be described in further detail below. Such configuration would thus prevent the post and toggle bolt assembly from falling down into the stake hole. As with various embodiments of assemblies 10 and 110, a rubber or foam gasket could also, as desirable, be placed below the metal plate to prevent scratching of the vehicle's paint, as may be preferable according to particular applications. Various embodiments of the base assembly 240 so configured will be described, in turn, below with reference to at least FIGS. 12-15.

Turning first to FIG. 12, the base assembly 240 according to various embodiments of the overall banner assembly 210 is illustrated. In certain embodiments, the base assembly 240 comprises a post 241, an adapter 242, a screw 243, and a stake hole mount assembly 244. It should be understood that according to various embodiments, at least the post 241 and the screw 243 may be configured in shape, size, material, and/or the like substantially the same as the posts 41, 141 and the screws 43, 143 described previously herein with respect to overall banner assemblies 10, 110. In other embodiments, however, it should also be understood that one or more features of the post 241 and the screw 243 may differ substantially relative to those of corresponding components within assemblies 10, 110.

As a non-limiting example, according to various embodiments of overall banner assembly 210, the screw 243 may comprise a Torx screw with a Torx screw head, as such as commonly known and understood in the art to involve a six-point star-shaped recess formed in the head portion thereof. As will be described in further detail below, such recess may be configured to substantially receive and retain a ball portion 249 of the stake hole mount assembly 244 when such is positioned substantially adjacent the base assembly 240 and in particular the screw 243 thereof. It should be understood that any of a variety of screw or other fastener types may be substituted in certain embodiments for the Torx screw configuration described above, provided such screw or fastener comprises a portion within the head thereof that is at least in part recessed for receipt of the ball portion 249, again as will be described in further detail below with reference to FIGS. 13-15.

Turning now to FIG. 13, according to various embodiments, it may be seen that the stake hole mount assembly 244 according to various embodiments comprises at least a top part 245, a bottom part 246, two or more fasteners 247, a spring portion 248, a ball portion 249, an elongate orifice 270, an elongate guard portion 272, two or more top part fastener holes 275, two or more bottom part fastener holes 276, and one or more bottom part alignment tabs 280.

The top part 245 according to various embodiments is made of a plastic material, of any variety and/or type as such are commonly known and understood in the art. In certain embodiments, the bottom part 246 may be formed from a steel or other metal-type material, of any variety and/or type as such are also commonly known and understood in the art. Of course, in still other embodiments, both parts 245, 246 may be formed from the same material and/or one or more materials other than plastic and/or steel and/or metal, however as may be desirable for a particular circumstance.

Remaining with FIG. 13, it may be seen that according to various embodiments, the top part 245 has defined thereon a spring portion 248 that is to some degree flexible relative to a remainder of the surface of the top part. In at least the illustrated embodiment, the spring portion 248 is defined at least in part by an elongate and substantially arc-shaped orifice 270 that separates a portion of the spring portion from the remainder of the surface of the top part. In this manner, the spring portion 248 may be default-biased so as to impose an upwardly-facing tension force (as directed toward the top of the page of FIG. 13, as illustrated). In this manner, as will be described in further detail below, the spring portion 248 and in particular the tension force created thereby relative to the remainder of the top part 245 retains the post 241 once the two are interlockingly positioned relative to one another, again as will be described in further detail below.

In certain embodiments, the spring portion 248 may have further formed thereon a ball portion 249, which ball portion may be configured according to various embodiments to substantially interlock with a portion of the base assembly 240. In at least the illustrated embodiment of FIG. 15, as will be described below, the ball portion 249 is configured to substantially and selectively interlock with the adapter 242 of the base assembly 240. According to various embodiments, the ball portion 249 may be positioned substantially centrally within a perimeter defined by the spring portion 248, whether by the orifice 270 or otherwise. In at least the illustrated embodiment, such is centrally located so that it may interlockingly engage with the Torx screw 243 (or other type fastener) passing through the center of the adapter 242 of the base assembly 240, as described further below.

According to various embodiments, the top plate 245 may have formed thereon and rising substantially perpendicular to a top surface thereof not only the ball portion 249 but also the elongate guard portion 272. In at least the illustrated embodiment, the guard portion 272 is substantially arc-shaped and semi-circular so as to correspond substantially to the shape of the adapter 242 of the base assembly 240. Of course, in other embodiments, the guard portion 272 may be otherwise shaped, for example partially-rectangular or partially-square shape where the adapter and/or base assembly may be so configured, however as may be desirable for particular circumstances or applications.

With reference to FIGS. 13 and 14 in combination, however, it should be understood that the elongate guard portion 272 defines a recess portion and a lip portion such that at least the base portion 242B of the adapter 242 (as will be described in further detail below) may be slidably received within a perimeter defined by the guard portion 272 and retained therein not only by the tension force imposed by the ball portion 249 but also by the lip portion of the guard portion 272. It may be best understood by considering that the lip portion and the ball/spring portions provide opposing forces upon a portion of the adapter 242, in particular upon the base portion 242B thereof, such that the latter is substantially retained, secured, immobilized, and/or interlockingly engaged between the surfaces thereof. With continued reference to FIG. 14, this may be further understood with reference to the direction of movement via arrow 290, via which the adapter 242 may be slid into the guard portion 272 of the top part 245 of the base assembly 240, whereby upon complete engagement therein, the ball/spring portions 248/249 enter the recess portion 242C of the adapter.

According to various embodiments, returning to FIG. 13, it should be understood that although the ball/spring portions 248/249 are illustrated as integral to the top part 245 (e.g., as molded as a single piece of material), in certain embodiments such may be separately formed, as may be desirable for particular applications. As also evident from FIG. 13, according to various embodiments, the holes 275 and 280 of the respective top and bottom plates may be configured to receive there-through at least two fasteners 247, as such are commonly known and understood in the art, so as to facilitate mounting of the assembly 244 to a surface 205 of a vehicle. It should be understood that according to various embodiments, the assembly 244 may be normally left on the surface 205 one initially mounted thereto, with selective replacement of a banner assembly (10, 110, 210, etc.) being performed via selective detachment/attachment of the banner portions other than the mounting assembly relative to the mounting assembly. Such configuration provides a quick connect and disconnect action for easy mounting and dismounting of customizable banner portions, as described previously herein.

With continued reference to FIG. 13, the bottom part 246 may be formed of a steel or metal material, as previously described and include at least one surface that is configured, when interconnected with the top part 245 (e.g., via the fasteners 247) to be substantially parallel to a corresponding surface of the top part 245, such that relative to both, the banner mast, when mounted, will be substantially perpendicular relative thereto. In certain embodiments, the bottom part 246 may include one or more alignment tabs 280, as may be desirable or beneficial for certain mounting surfaces (e.g., the side of a truck bed, or a truck bed liner, or the like). In other embodiments, the bottom part 246 may dispense with any of such tabs 280, as may be alternatively desirable.

In still other embodiments, the top part 245 of adapter 242 may be configured to mount to a surface using only fasteners and without using a bottom part 246; in such instances the bottom part 246 may be wholly dispensed with, however as may be desirable and/or necessary for a particular scenario. In these and yet still other embodiments, the top part 245 may be configured to mount to another surface such as a bike rack with two (or more) bottom parts 246 (e.g., one on either side of the bike rack), also however as may be desirable and/or necessary for a particular scenario. It should be understood, however, that in any of these and still other envisioned embodiments, the structural utility of the respective top and bottom parts and/or the top part alone remains substantially the same, as described elsewhere herein.

Turning now to FIG. 15, the post 241, the adapter 242, and the screw 243 (although not labeled) are illustrated according to various embodiments. As it may be seen, the post 241 in certain embodiments may be configured substantially the same in shape, size, material composition, and the like as posts 41 and 141, both as previously described herein. A lower portion of the post 241, however, should be configured for matingly engaging the adapter 242, generally via a central bore hole extending through the center of the adapter (see also FIG. 12). The screw 243 is configured to pass through this central bore hole and further into an opening within the post 241, the latter being in certain embodiments threaded so as to engagingly receive the screw 243. In this manner, the adapter is fixedly attached relative to the post 241. Of course, in other embodiments, the post, adapter, and screw (or detent) may be made from a single molded part, thus eliminating the need in those embodiments for a separate adapter piece and/or a Torx screw. It should be understood, however, that even in such embodiments, a structural configuration much like that provided via the post, adapter, and screw (or detent) configuration would be provided, merely via a single molded piece, versus via three separate components.

Turning back to FIG. 15, it should be understood that the screw 243 (whether a Torx screw or otherwise configured, as previously described herein) provides a dual functionality. Not only does such fasten the adapter 242 to the post 241, but such also acts as a detent (at least the head portion thereof does) for the ball/detent locking action that occurs therebetween with the ball/spring portion of the mount assembly 244 previously described herein.

With further reference to FIG. 15, according to various embodiments, the adapter 242 may comprise a tower portion 242A, a base portion 242B, a recess portion 242C, and a central orifice (or bore hole) 242D. The orifice 242D is configured to receive not only the screw 243 but also a portion of the post 241 in certain embodiments. Similarly, the recess portion 242C is configured to receive at least a portion of the ball portion 249 during use of the ball/detent locking configuration, as illustrated further in FIG. 14. The differing structural diameter of the adapter 242 as between the tower portion 242A and the base portion 242B, as illustrated, provides a configuration wherein due to the greater diameter of the base portion 242B, such is retained within and under the lip portion of the guard portion 272 of the mount assembly 244, as previously described herein, whereas the diameter of the tower portion 242A is less than a diameter defined by an arc of the guard portion 272 according to various embodiments. Although generally circular and/or arc-shaped structural configurations are illustrated, in other embodiments, analogous interlockingly engaging and/or mating structures may be provided that are, as non-limiting examples, substantially rectangular, square, triangular, or otherwise, however as may be desirable for particular circumstances.

It should be understood, however, that according to any of these and still other embodiments, as may be understood with further reference to FIGS. 14 and 15 in combination, the ball portion 249 is generally configured to snap into the screw 243 head (Torx or otherwise) and thus lock the banner assembly 210 in place via the spring tension force imposed by the spring portion 248 upon a bottom surface of the adapter 242, such that a surface of the base portion 242B thereof substantially engages a lip portion of the elongate guard portion 272, as previously described herein. In this manner, the banner assembly 210 is fixedly mounted relative to the mount assembly 244 and thus further fixedly mounted relative to the surface 205 of a vehicle, but for the pivoting action of the banner mast relative to the mount assembly, as also described previously herein and understood by analogy to corresponding components of assemblies 10 and 110.

Panel Mount Rivets 250

According to various embodiments, panel mount rivets 250 are used to attach the leading edge (understood by analogy to edge 24 of assembly 10) of the banner panel 220 within the slot (understood by analogy to slot 34 of assembly 10) of the banner mast flange 233. Corresponding holes in the flange 233 and the banner panel 220 facilitate such attachment. Three are shown in for example FIG. 12, but other numbers could be used without departing from the spirit and scope of the present invention.

Still further, although rivets 250 are illustrated, any of a variety of types and sizes of fasteners, as commonly known and understood to exist in the art may be used, as may be desirable or necessary for specific applications, without departing from the spirit and scope of the present disclosure.

According to various embodiments the rivets 250 and/or any comparable or otherwise desirable and suitable fastener as may be incorporated within banner assembly 210 may be substantially the same in shape, size, material composition, and configuration as those fasteners described elsewhere herein in the context of assemblies 10 and 110. In other embodiments, of course, the fasteners selected for banner assembly 210 may differ substantially from those incorporated and/or otherwise described herein with respect to assemblies 10 and 110.

Mast Retention Rivet 260

According to various embodiments, the mast retention rivet 260 is configured to prevent the banner mast base 231 from becoming axially detached from the post 241 of the magnetic base assembly, while at the same time still allowing the banner mast base 31 to rotate or pivot about pivot axis PA (see by analogy to FIG. 1). This rivet 260 may be configured for easy installation or removal and may be configured according to various embodiments much like a "set-screw," with such features as such are commonly known and understood in the art to involve.

According to various embodiments the rivet 260 and/or any comparable or otherwise desirable and suitable fastener as may be incorporated within banner assembly 210 may be substantially the same in shape, size, material composition, and configuration as the rivet 60 described elsewhere herein in the context of assembly 10. In other embodiments, of course, the rivet 260 selected for banner assembly 210 may differ substantially from that incorporated and/or otherwise described herein with respect to assembly 10, however as may be desirable for particular applications.

General Operation and Features of Embodiment 210

According to various embodiments, the banner assembly 210 is configured to attach to a vehicle surface such as 205 (e.g. a roof or trunk lid or truck bed side surface or the like), as illustrated in at least FIGS. 16-17. Via such surface, the base assembly 240 is fixed to the surface 5, thus fixing the banner mast 230 and the banner panel 220 and thus the entire banner assembly 210 relative to the surface, but for the pivoting of at least the banner mast 230 about pivot axis PA (see by analogy FIG. 1; see also FIG. 17).

With continued reference to FIG. 17, it should be understood that according to various embodiments where mounting may onto certain truck bed top sides that are angled with respect to a horizontal plane (e.g., by a degree a), the angle thereof may be compensated for by either adding an angle to the bottom surface of the top plate of the base assembly 240 or by inserting one or more separately formed/defined wedge pieces (not shown) between the bottom surface of the top plate of the base assembly 240 and the surface of the truck bed (or other comparable angled surface). It should be understood that regardless of whether or not any angular surface is involved, the top plate of the base assembly 240 and in certain embodiments the assembly 240 in its entirety should be positioned such that it is substantially aligned with a horizontal plane. In this manner, the mast base 231 is aligned substantially vertical and perpendicular thereto upon selective attachment via the spring/ball surfaces of the base assembly 240, as described previously herein.

Still further, as previously described, at least some angle Θ greater than zero of the mast and/or mast flange 233 relative to pivot axis PA improves aerodynamics at least in part by reducing the pressure drag force imposed upon the banner panel 220. Such may be understood also by analogy to assemblies 10 and 110, as previously described herein.

Materials of Embodiment 210

As with embodiments of assemblies 10 and 110, for the various embodiments of assembly 210, materials with a low coefficient of friction were chosen to allow the mast to spin freely around the post. These materials are also wear resistant to increase the life of the parts over repeated movements. Exemplary materials include Polyoxymethylene (POM) (commonly known as Acetal) which is an engineering thermoplastic; Tradenames include Delrin, Celcon, and Hostaform. One embodiment includes the use of Delrin 527UV (a UV-resistant version of Delrin). Still other embodiments may include the use of Nylon (e.g., Zytel or specifically Zytel PA66) as post material 41 to at least in part reduce noise. In certain embodiments mast 30 formed from Delrin 527UV positioned against post 41 of Zytel results in less squeaking or comparable noise as compared to two adjacently positioned components both made of Delrin 527UV. However, other suitable materials and/or combinations of material may be substituted without departing from the spirit and scope of the present invention.

A rigid or semi-rigid flag material allows the mast-flag assembly to self-align with the wind. Durability is also improved since the violent flapping of a cloth flag is reduced or eliminated.

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A detachable vehicle-mounted banner assembly having improved display and mounting features, said banner assembly comprising:

a banner panel defining two opposing and at least semi-rigid surfaces, said surfaces comprising at least an angled leading edge;

a banner mast comprising:

an elongate base portion defining a base longitudinal axis and having a hollow interior cavity extending parallel to the base longitudinal axis; and an elongate flanged portion defining a flange longitudinal axis extending away from the base portion at an acute angle relative to said base longitudinal axis, said flanged portion comprising an angled leading edge substantially parallel to the flange longitudinal axis and an angled trailing slot substantially parallel to the flanged longitudinal axis, the angled trailing slot being configured to selectively engage at least said angled leading edge of said banner panel; and a base assembly having a first portion configured for attachment adjacent a surface of a vehicle and a second portion configured to pivotably engage the hollow interior cavity of the elongate base portion of said banner mast, wherein said banner mast and the banner panel pivot about the second portion of the base assembly.

2. The assembly of claim 1, wherein said acute angle is approximately 45 degrees.

3. The assembly of claim 1, wherein said acute angle is in a range of between approximately 40 degrees and 50 degrees.

4. The assembly of claim 1, wherein said acute angle is in a range of between approximately 35 degrees and 55 degrees.

5. The assembly of claim 1, wherein each of said two opposing and at least semi-rigid surfaces comprise a logo-affixing portion configured for receipt thereon of at least one of a logo, an advertisement, or a representation of sporting paraphernalia.

6. The assembly of claim 1, further comprising two or more fasteners configured to fixedly mount said leading edge of said banner panel within said trailing slot of said banner mast and to said flanged portion of said banner mast.

7. The assembly of claim 6, wherein said two or more fasteners comprise at least one of:

a plurality of fasteners spaced and extending along a length of said flanged portion; or two or more rivets.

8. The assembly of claim 1, wherein:

said base assembly comprises an elongate post having a post longitudinal axis; and said hollow interior cavity of said elongate base portion of said banner mast is sized and configured to receive said elongate post therein such that said mast and said post longitudinal axes are substantially aligned relative to one another during use of the banner assembly.

9. The assembly of claim 8, wherein:

said elongate post comprises at least one ribbed surface; and said assembly further comprises at least one retention fastener, said retention fastener being configured to extend perpendicular to said mast and said post longitudinal axes such that the fastener engages the at least one ribbed surface if the mast base is translated longitudinally relative to the elongate post, such that removal of the elongate post from the elongate cavity of the mast base is substantially prevented by the retention fastener.

10. The assembly of claim 9, wherein said retention fastener does not engage a surface of said elongate post other than said at least one ribbed surface, such that during use the mast base is configured to freely pivot about said elongate post and about said base longitudinal axis.

11. The assembly of claim 8, wherein said base assembly comprises a magnetic subassembly configured for selective attachment to a metal surface of said vehicle.

12. The assembly of claim 11, wherein said base assembly further comprises a screw configured for fixedly attaching said magnetic subassembly relative to said elongate post.

13. The assembly of claim 11, wherein said base assembly further comprises at least one of a protective label or a protective boot configured to substantially prevent scratching of said metal surface of said vehicle.

14. The assembly of claim 8, wherein:

said elongate post comprises a plurality of externally-facing post threads; and said mast base comprises a plurality of internally-facing threads, the mast base threads being configured to substantially mate with said post threads for selective attachment of said elongate post to said mast base.

15. The assembly of claim 14, wherein a greater number of post threads are present relative to a number of said mast base threads, such that upon selective attachment of said elongate post to said mast base, all of said post threads are internally positioned within said at least one hollow interior cavity and no longer mated with said mast base threads.

16. The assembly of claim 8, wherein said base assembly further comprises an adapter and at least one mounting part, said adapter being fixedly attached to said elongate post and being selectively attachable to said at least one mounting part.

17. The assembly of claim 8, wherein said base assembly further comprises an adapter and at least two mounting parts, said adapter being fixedly attached to said elongate post and being selectively attachable to at least one of said two mounting parts.

18. The assembly of claim 17, wherein:

said adapter comprises a detent portion;

said one of said at least two mounting parts comprises a ball portion and a spring portion;

said detent portion of said adapter is configured to selectively receive said ball portion therein; and said spring portion of said one of said at least two mounting parts is configured to securely retain said detent portion relative to said ball portion via a spring tension imposed thereby upon said adapter.

19. The assembly of claim 1, wherein said base assembly comprises:

a magnetic subassembly configured for selective attachment to a metal surface of said vehicle; and a screw configured for attaching said magnetic subassembly relative to said second portion of said base assembly.

20. The assembly of claim 19, wherein:

said base assembly comprises an elongate post having a post longitudinal axis; and said hollow interior cavity of said elongate base portion of said banner mast is sized and configured to receive said elongate post therein such that said mast and said post longitudinal axes are substantially aligned relative to one another during use of the banner assembly, wherein:

said elongate post comprises a plurality of externally-facing post threads; and said mast base comprises a plurality of internally-facing threads, the mast base threads being configured to substantially mate with said post threads for selective attachment of said elongate post to said mast base.

21. The assembly of claim 1, wherein:

said surfaces of said banner panel define a banner lower edge oriented at an acute angle relative to said angled leading edge; and said acute angle between said banner lower edge and said angled leading edge corresponds to the acute angle between the flange longitudinal axis and the base longitudinal axis such that the banner lower edge is perpendicular to the base longitudinal axis when the angled leading edge of said banner panel is engaged within said angled trailing slot.

22. A method of mounting a detachable vehicle-mounted banner assembly having improved display and mounting features, said method comprising the steps of:

fixedly attaching a base assembly to a surface of said vehicle, said base assembly having a first portion configured for attachment adjacent said surface of said vehicle and a second portion configured to pivotably engage a hollow interior cavity of an elongate base portion of a banner mast of the banner assembly; and selectively attaching said banner mast to said second portion of said base assembly, said banner mast comprising:

an elongate base portion defining a base longitudinal axis and having the hollow interior cavity extending parallel to the base longitudinal axis; and an elongate flanged portion defining a flange longitudinal axis extending away from the base portion at an acute angle relative to said base longitudinal axis, said flanged portion comprising an angled leading edge substantially parallel to the flange longitudinal axis and an angled trailing slot substantially parallel to the flanged longitudinal axis, the angled trailing slot being configured to selectively engage at least an angled leading edge of a banner panel.

23. The method of claim 22, further comprising the step of selectively attaching a banner panel within said trailing slot of said flanged portion of said banner mast, said banner panel defining two opposing and at least semi-rigid surfaces configured to receive thereon one or more of a logo, an advertisement, or an indicia conveying information.

24. The method of claim 22, wherein said selective attachment of said banner mast to said second portion of said base assembly comprises the steps of:

selectively attaching an elongate post to a base portion of said banner mast; and selectively engaging a detent area of said elongate post with a ball and spring configuration of said second portion of said base assembly, such that said ball and spring configuration imposes a spring tension force upon said detent area.

* * * * *